US005358811A

United States Patent [19]

Yamazaki et al.

[11] Patent Number: 5,358,811

[45] Date of Patent: Oct. 25, 1994

[54] ELECTROPHOTOGRAPHIC METHOD USING AN AMORPHOUS SILICON LIGHT RECEIVING MEMBER WITH A LATENT IMAGE SUPPORT LAYER AND A DEVELOPED IMAGE SUPPORT LAYER AND INSULATING TONER HAVING A VOLUME AVERAGE PARTICLE SIZE OF 4.5 TO 9.0 MICRON

[75] Inventors: Koji Yamazaki; Toshimitsu Kariya; Tatsuyuki Aoike; Toshiyuki Ehara; Takehito Yoshino; Hirokazu Otoshi, all of Nagahama, Japan

[73] Assignee: Canon Kabushiki Kaisha, Tokyo, Japan

[21] Appl. No.: 53,822

[22] Filed: Apr. 29, 1993

Related U.S. Application Data

[63] Continuation of Ser. No. 935,356, Aug. 28, 1992, abandoned, which is a continuation of Ser. No. 811,925, Dec. 23, 1991, abandoned, which is a continuation of Ser. No. 456,741, Dec. 26, 1989, abandoned.

[30] Foreign Application Priority Data

Dec. 27, 1988 [JP] Japan ..... 63-329636

[51] Int. Cl.[5] ..... G03G 13/01; G03G 13/08

[52] U.S. Cl. ..... 430/42; 430/31; 430/57; 430/111

[58] Field of Search ..... 430/42, 57, 111

[56] References Cited

U.S. PATENT DOCUMENTS

| | | | |
|---|---|---|---|
| 3,639,245 | 2/1972 | Nelson et al. | 430/109 |
| 3,938,992 | 2/1976 | Jadwin | 430/107 X |
| 4,220,698 | 9/1980 | Brynko et al. | 430/106.6 |
| 4,544,617 | 10/1985 | Mort et al. | 430/57 X |
| 4,775,606 | 10/1988 | Shirai | 430/67 |
| 4,795,691 | 1/1989 | Takei et al. | 430/67 |
| 4,845,001 | 7/1989 | Takei et al. | 430/66 |
| 4,882,251 | 11/1989 | Aoike et al. | 430/57 |
| 4,886,723 | 12/1989 | Aoike et al. | 430/57 |

*Primary Examiner*—Roland Martin

*Attorney, Agent, or Firm*—Fitzpatrick, Cella, Harper & Scinto

[57] ABSTRACT

An electrophotographic image-forming and developing method using as light receiving member an amorphous silicon light receiving member which comprises a substrate and a light receiving layer disposed on said substrate, said light receiving layer comprising a first layer capable of exhibiting a photoconductivity, a second layer capable of supporting a latent image and a third layer capable of supporting a developed image being laminated in this order on said substrate, said first layer being formed of an amorphous material containing silicon atoms as a matrix, and at least one kind of atoms selected from the group consisting of hydrogen atoms and halogen atoms, said second layer being formed of an amorphous material containing silicon atoms as a matrix, carbon atoms, atoms of an element belonging to Group III of the Periodic Table, and at least one kind of atoms selected from the group consisting of hydrogen atoms and halogen atoms, and said third layer being formed of an amorphous material containing silicon atoms as a matrix, carbon atoms and at least one kind of atoms selected from the group consisting of hydrogen atoms and halogen atoms; and using as said toner a fine particle insulating toner having a volume average particle size in the range of 4.5 to 9 um and an apparent viscosity at 100° C. in the range of $1\times10^4$ to $2\times10^5$ poise.

12 Claims, 12 Drawing Sheets

RESOLUSION
(THE IMAGE OBTAINED IN COMPARATIVE EXPERIMENT WHEN THE TONER OF 12μm IN VOLUME AVERAGE PARTICLE SIZE WAS USED IS MADE 1)

TONE REPRODUCTION
(THE IMAGE OBTAINED IN COMPARATIVE EXPERIMENT WHEN THE TONER OF 12μm IN VOLUME AVERAGE PARTICLE SIZE WAS USED IS MADE 1)

TONE REPRODUCTION
(THE IMAGE OBTAINED IN EXPERIMENT 2 WHEN THE TONER OF ABOUT 6μm IN VOLUME AVERAGE PARTICLE SIZE AND OF ABOUT $6\times10^4$ POISE IN APPARENT COEFICIENT OF VISCOSITY WAS USED IS MADE 1)

(THE IMAGE OBTAINED IN EXPERIMENT 3 WHEN THE TONER OF ABOUT 6μm IN VOLUME AVERAGE PARTICLE SIZE AND OF ABOUT $6\times10^4$ POISE IN APPARENT COEFICIENT OF VISCOSITY WAS USED IS MADE 1)

UNEVEN IMAGE DENSITY
(THE IMAGE OBTAINED IN EXPERIMENT 4 WHEN THE TONER OF ABOUT 6μm IN VOLUME AVERAGE PARTICLE SIZE AND OF ABOUT $6\times10^4$ POISE IN APPARENT COEFICIENT OF VISCOSITY WAS USED IS MADE 1)

ELECTROPHOTOGRAPHIC METHOD USING AN AMORPHOUS SILICON LIGHT RECEIVING MEMBER WITH A LATENT IMAGE SUPPORT LAYER AND A DEVELOPED IMAGE SUPPORT LAYER AND INSULATING TONER HAVING A VOLUME AVERAGE PARTICLE SIZE OF 4.5 TO 9.0 MICRON

This application is a continuation of U.S. patent application Ser. No. 07/935,356, filed Aug. 28, 1992, now abandoned; which in turn, is a continuation of U.S. patent application Ser. No. 07/811,925, filed Dec. 23, 1991, now abandoned; which in turn, is a continuation of U.S. application Ser. No. 07/456,741, filed Dec. 26, 1989, now abandoned.

FIELD OF THE INVENTION

The present invention relates to an improved electrophotographic image-forming method which stably and repeatedly provides high quality full color images excelling in resolution and tone reproduction. More particularly, the present invention relates to an improved electrophotographic image-forming method using (i) an amorphous silicon light receiving member having a photoconductive layer, a latent image support layer and a developed image support layer and (ii) fine particle insulating toner having a volume average particle size of 4.5 to 9 μm and an apparent viscosity of $1\times10^4$ to $2\times10^5$ poise at 100° C. which makes it possible to stably and repeatedly provide high quality full color pictorial images excelling in resolution and tone reproduction at high speed.

BACKGROUND OF THE INVENTION

There have been proposed a number of amorphous silicon system light receiving members. They have been evaluated as being suitable as electrophotographic light receiving members for use not only in high speed electrophotographic copying machines but also in laser beam printers since they are high in surface hardness, highly sensitive to a long wavelength light such as semiconductor laser beam (770 nm–800 nm), and hardly deteriorated even upon repeated use for a long period of time.

FIG. 3 is a schematic cross section view of a typical configuration of such amorphous silicon system light receiving member, which comprises an electroconductive substrate 301 made of a proper material such as aluminum and a light receiving layer comprising a charge injection inhibition layer 302 capable of preventing injection of a charge from the side of the substrate 301, a photoconductive layer 303 exhibiting photoconductivity and a surface protective layer 304.

The image formation using said light receiving member is carried out, for example, in the following manner by using an appropriate electrophotographic copying machine as shown in FIG. 4.

FIG. 4 is a schematic explanatory view of the constitution of a conventional electrophotographic copying machine. As shown in FIG. 4, near a cylindrical light receiving member 401 having the configuration shown in FIG. 3 which rotates in the direction indicated by an arrow, there are provided a main corona charger 402, an electrostatic latent image-forming mechanism 403, a development mechanism 404, a transfer sheet feeding mechanism 405, a transfer charger 406(*a*), a separating charger 406(*b*), a cleaning mechanism 407, a transfer sheet conveying mechanism 408 and a charge-removing lamp 409.

The cylindrical light receiving member 401 is maintained at a predetermined temperature by a heater 423. The cylindrical light receiving member 401 is uniformly charged by the main corona charger 402 to which a predetermined voltage is impressed. Then, an original 412 to be copied which is placed on a contact glass 411 is irradiated with a light from a light source 410 such as a halogen lamp or fluorescent lamp through the contact glass 411, and the resulting reflected light is projected through mirrors 413, 414 and 415, a lens system 417 containing a filter 418, and a mirror 416 onto the surface of the cylindrical light receiving member 401 to form an electrostatic latent image corresponding to the original 412.

This electrostatic latent image is developed with toner supplied by the development mechanism 404 to provide a toner image. A transfer sheet P is supplied through the transfer sheet feeding mechanism 405 comprising a transfer sheet guide 419 and a pair of feed timing rollers 422 so that the transfer sheet P is brought into contact with the surface of the cylindrical light receiving member 401, and corona charging is effected with the polarity different to that of the toner from the rear of the transfer sheet P by the transfer charger 406(*a*) to which a predetermined voltage is applied in order to transfer the toner image onto the transfer sheet P. The transfer sheet P having the toner image transferred thereon is electrostatically removed from the cylindrical light receiving member 401 by the charge-removing action of the separating corona charger 406(*b*) where a predetermined AC voltage is impressed and is then conveyed by the transfer sheet conveying mechanism 408 to a fixing mechanism 420. The residual toner on the surface of the cylindrical light receiving member 401 is removed by a cleaning blade 421 upon arrival at the cleaning mechanism 407 and the removed toner is discharged by way of waste toner discharging means (feed-screw) 424. Thereafter, the thus cleaned cylindrical light receiving member 401 is entirely exposed to light by the charge-removing lamp 409 to erase the residual charge and is recycled.

The amorphous silicon system light receiving member to be used in the image-forming process as above described has such advantages as above mentioned, for example, it exhibits a high sensitivity against a long wavelength light (sensitivity peak near 680 nm and sensitivity region of 400 to 800 nm), and it is satisfactory in practice since practical, acceptable images without accompaniment of crushed line image or slime line image can be reproduced as long as ordinary documents are copied. However, it is not sufficient enough to meet a recently increased demand to provide a high quality image equivalent to a printed image obtained by a printing machine.

That is, when it is attempted to reproduce an original containing superfine lines of 100 μm or less in width by the foregoing image-forming method using such amorphous silicon system light receiving member as above mentioned, there often appear undesirably fattened lines or undesirably slimed lines on the resulting copied lines. Likewise, when it is attempted to reproduce an original containing complicated chinese characters (KANZI in Japanese) of 2 mm or less in size the foregoing image-forming method, the resulting copied chinese characters often have crushed line images or slime line images which can not be easily distinguished.

Therefore, it is generally recognized that the foregoing image-forming method using an amorphous silicon system light receiving member is not suitable for reproducing such originals as above mentioned, for example, catalogs or manuals of articles for sale, etc., mainly because of insufficient resolution.

The foregoing problem is apparently caused when the image-forming method is practiced under a highly humid environment. In order to eliminate this problem, there has been proposed a method of heating the amorphous silicon system light receiving member. However, it is still difficult to obtain desirable copied images from such originals containing superfine lines or complicated chinese characters.

Further, in recent years, there have been frequently using full color copies of catalogs or manuals of articles for sale, etc. and along with this, there is an increased demand for further improvement in the durability of a light receiving member such as organic photosensitive member, selenium system photosensitive member or selenium-tellurium system photosensitive member to be used in an electrophotographic full color copying machine. In order to meet this demand, there has been made a proposal to use an amorphous silicon system light receiving member instead of such photosensitive members.

Further, in the conventional full color pictorial image-forming method, full color pictorial images are obtained by using cyanic toner (C), Magenta toner (M) and yellow toner (Y), and if necessary, black toner (B), melting and mixing them on a transfer sheet, followed by fixing to form said full color pictorial images. For these color toners, resins which can be melted at a low temperature and completely fused within a narrow range of temperature (these resins will be hereinafter referred to as "sharp melt resins ") are used.

On the other hand, in the conventional image-forming method using an amorphous silicon system light receiving member, the image-forming process is carried out while maintaining said light receiving member at a high temperature of 40 to 50° C. Because of this, problems often occur when the foregoing color toners are used in this image-forming process in that these toners are fused not only in the development mechanism but also in the cleaning mechanism to thereby block these mechanisms and as a result, it becomes impossible to obtain full color pictorial images.

SUMMARY OF THE INVENTION

The present invention is aimed at eliminating the foregoing disadvantages which are found on the aforementioned known image-forming method and developing an improved image-forming method which makes it possible to reproduce desirable high quality images even from originals containing superfine lines or/and complicated minute chinese characters at high speed by using an amorphous silicon light receiving member and which meets the above-mentioned demands.

Another object of the present invention is to provide an improved high speed full color pictorial image-forming method which makes it possible to reproduce superfine lines and minute dots contained in an original in a state equivalent to the original and to provide high quality full color pictorial images.

The gist of the present invention which attains the above objects lies in an improved full color pictorial image-forming method to be practiced in an electrophotographic copying system, characterized by: using in combination (i) a light receiving member which comprises a substrate and a light receiving layer disposed on said substrate, said light receiving layer comprising (a) a first layer exhibiting photoconductivity (hereinafter referred to as "photoconductive layer") which is formed of an amorphous material containing silicon atoms (Si) as a matrix, and at least hydrogen atoms (H) and/or halogen atoms (X) (this amorphous material will be hereinafter referred to as "a-Si(H,X)"), (b) a second layer capable of supporting a latent image (hereinafter referred to as "latent image support layer") which is formed of an amorphous material containing silicon atoms (Si) as a matrix, carbon atoms (C) and atoms of an element belonging to Group III of the Periodic Table (hereinafter referred to as "Group III element"), and at east hydrogen atoms (H) and/or halogen atoms (X) (this amorphous material will be hereinafter referred to as "a-SiC:M(H,X)", where M stands for atoms of Group III element) and (c) a third layer capable of supporting a developed image (hereinafter referred to as "developed image support layer") which is formed of an amorphous material containing silicon atoms (Si) as a matrix, carbon atoms (C), and at least hydrogen atoms (H) and/or halogen atoms (X) (this amorphous material will be hereinafter referred to as "a-SiC(H,X)"), said three layers (a) to (c) being laminated in this order from the side of said substrate, and (ii) fine particle insulating toner having a volume average particle size of 4.5 to 9 μm and an apparent viscosity of $1\times10^4$ to $2\times10^5$ poise at 100° C. which can be melted at a low temperature and completely fused with a narrow range of temperature (this toner will be hereinafter referred to as "fine particle insulating toner" or "sharp melt fine particle insulating toner" as a developer; and not using any heater for heating said light receiving member during the film-forming process.

DETAILED DESCRIPTION OF THE INVENTION

The present inventors have conducted extensive studies through experiments in order to eliminate the foregoing disadvantages which are found on the known image-forming method and in order to attain the objects of the invention, and as a result, have found that when a specific amorphous silicon light receiving member and a specific fine particle insulating toner are used in combination, the objects of the invention can be effectively attained. Specifically, the present invention has been accomplished based on the findings obtained through the following experiments.

The electrophotographic image-forming method according to the present invention makes it possible to stably and repeatedly provide high quality copied full color pictorial images excelling in resolution and tone reproduction at high speed under any environmental condition.

The reason why these significant effects are provided by the combined use of a specific amorphous silicon light receiving layer and a specific sharp melt fine particle insulating toner are not clear. But as can be recognized from the results of the below mentioned experiments, it is presumed due to the synergism of the following factors: since the amorphous silicon light receiving member is provided with the latent image support layer under the developed image support layer, a desirable latent image is effectively formed without having negative influences due to changes in environmental condition; since the latent image is developed through the developed image support layer with the use of the specific sharp melt fine particle insulating toner, a coulomb force effectively works between the latent image and the specific sharp melt fine particle insulating toner; and the amorphous silicon light receiving member is not purposely heated by a heater as in the case of the conventional full-color pictorial image-forming method.

In the following, the present invention will be more detailed.

Light Receiving Member

Figure 1A:
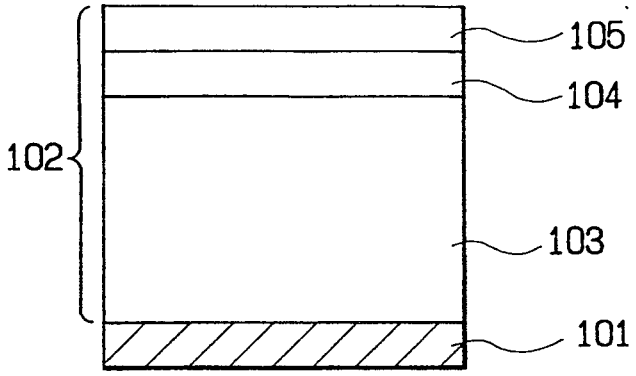
FIG. 1(A) through FIG. 1(C) are schematic views respectively illustrating the typical layer constitution of a representative amorphous silicon light receiving member to be used in the present invention.
Figure 1B:
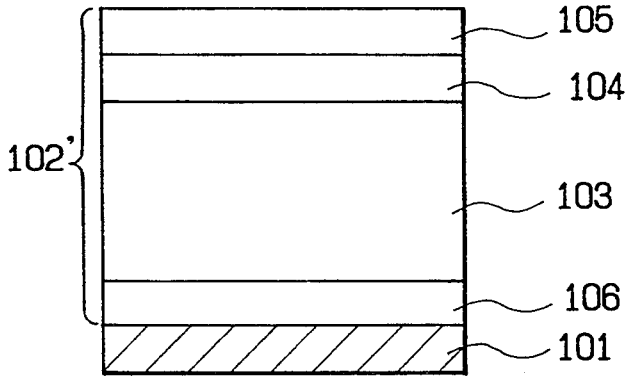
Figure 1C:
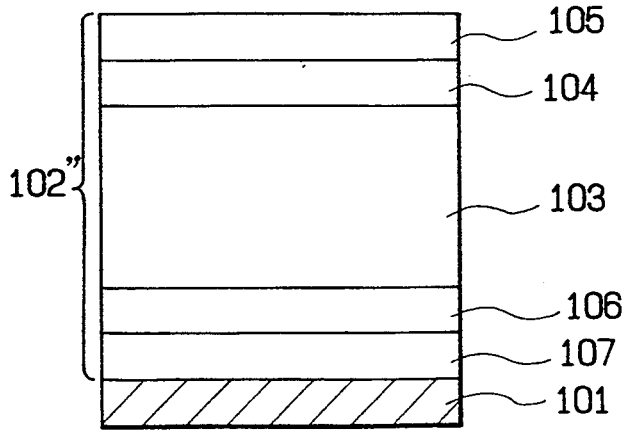

FIGS. 1(A), 1(B) and 1(C) are schematic cross-sectional views respectively illustrating the layer constitution of the light receiving member to be used in the present invention.

FIG. 1(A) shows the most typical layer constitution of the light receiving member to be used in the present invention which comprises an electroconductive substrate 101 made of an electroconductive material such as aluminum and a light receiving layer 102 disposed on the substrate 1, the light receiving layer 102 comprising a photoconductive layer 103 formed of a-Si(H,X), a latent image support layer 104 formed of a-SiC:M(H,X) and a developed image support layer 105 formed of a-SiC(H,X) being laminated in this order from the side of the substrate 101.

FIG. 1(B) shows another layer constitution of the light receiving member to be used in the present invention which comprises the foregoing substrate 101 and a light receiving layer 102' disposed on the substrate 1010 said light receiving layer 102' comprising a charge injection inhibition layer 106 formed of an amorphous material containing silicon atoms (Si) as a matrix, hydrogen atoms (H) and/or halogen atoms (X), and at least one kind of atoms selected from the group consisting of carbon atoms (C), atoms of Group element, atoms of Group V element (excluding N) and atoms of Group VI element (excluding O) and further optionally, at least one kind of atoms selected from the group consisting of nitrogen atoms (N) and oxygen atoms (O) [this amorphous material will be referred to as "a-Si(H,X)(C,M')(N,O)", where M' stands for atoms of Group III element, V element (excluding N) or VI element excluding O)], a photoconductive layer 103 formed of a-Si (H,X), a latent image support layer 104 formed of a-SiC:M (H,X) and a developed image support layer 105 formed of a-SiC(H,X) being laminated in this order from the side of the substrate 101.

FIG. 1(C) shows a further layer constitution of the light receiving member to be used in the present invention which comprises the foregoing substrate 101 and a light receiving layer 102" disposed on the substrate 101, the light receiving layer 102" comprising a long wavelength light absorptive layer (this layer will be hereinafter referred to as "IR absorptive layer") 107 formed of an amorphous material containing silicon atoms (Si) as a matrix, hydrogen atoms (H) or/and halogen atoms (X), germanium atoms (Ge) or/and tin atoms (Sn), and optionally at least one kind of atoms selected from the group consisting of carbon atoms, atoms of Group III element, atoms of Group V element (excluding N) and atoms of Group VI element (excluding O) and further optionally, at least one kind of atoms selected from the group consisting of nitrogen atoms (N) and oxygen atoms (O) [this amorphous material will be hereinafter referred to as "a-Si(Ge,Sn)(H,X)(C,M')(N,O)", where M' stands for atoms of Group III element, V element (excluding N) or VI element (excluding O)], a charge injection inhibition layer 106 formed of a-Si(H,X)(C,M')(N,O), a photoconductive layer 103 formed of a-Si(H,X), a latent image support layer 104 formed of a-SiC:M(H,X) and a developed image support layer 105 formed of a-SiC(H,X) being laminated in this order from the side of the substrate 101. In this case, it is possible to dispose the IR absorptive layer 107 between the substrate 101 and the photoconductive layer 103 without disposing the charge injection inhibition layer 106.

The photoconductive layer 103 is basically formed a-aSi(H,X) as described above, but it may contain at least one kind of atoms selected from the group consisting of carbon atoms (C), nitrogen atoms (N), oxygen atoms (O), germanium atoms (Ge), tin atoms (Sn), atoms of Group III element, atoms of Group V element (excluding N) and atoms of Group V element (excluding O) in case where necessary.

As for the hydrogen atoms (H) and/or the halogen atoms (X) to be contained in the photoconductive layer 103, the amount of the hydrogen atoms (H), the amount of the halogen atoms (X) , or the sum of the amounts of the hydrogen atoms (H) and the halogen atoms (H+X) is desired to be in the range of 0.1 to 40 atomic %.

In the case where the photoconductive layer 103 contains atoms of Group III element, the amount of the atoms is desired to be controlled to an amount corresponding one fifth of the amount of the atoms of Group III element contained in the latent image support layer 104.

The photoconductive layer 103 is desired to be 1 to 100 μm thick.

The latent image support layer 104 is basically formed of a-SiC:M(H,X), but it may contain at least one kind of atoms selected from the group consisting of germanium atoms (Ge), tin atoms (Sn), nitrogen atoms (N), oxygen atoms (O), atoms of Group V element (excluding N) and atoms of Group VI element (excluding O) in case where necessary.

The amount of the carbon atoms (C) to be contained in the latent image support layer 104 is desired to be in the range of 1 to 90 atomic %. As for the atoms of Group III element to be contained in the latent image support layer 104, it is desired to be in the range of 1 to $5\times10^4$ atomic ppm. Further, as for the hydrogen atoms (H) and/or the halogen atoms (X) to be contained in the latent image support layer 104, the amount of hydrogen atoms (H), the amount of halogen atoms (X) or the sum of the amounts of the hydrogen atoms and the halogen atoms (H+X) is desired to be in the range of 0.1 to 70 atomic %.

The latent image support layer 104 is desired to be 0.003 to 30 μm thick.

The developed image support layer 105 is basically formed of a-SiC(IT,X), but it may contain at least one kind of atoms selected from the group consisting of germanium atoms (Ge), tin atoms (Sn), atoms of Group III element, element (excluding N) and atoms of Group VI element (excluding O) in case where necessary.

The amount of the carbon atoms (C) to be contained in the developed image support layer 105 is desired to be in the range of 1 to 90 atomic %. And in a most preferred embodiment in this respect, the amount of the carbon atoms (C) is desired to be greater than that contained in the latent image support layer 104.

As for the hydrogen atoms (H) and/or the halogen atoms (X) to be contained in the developed image support layer 105, the amount of the hydrogen atoms (H), the amount of the halogen atoms (X), or the sum of the amounts of the hydrogen atoms and the halogen atoms (H+X) is desired to be in the range of 0.1 to 70 atomic %. Further, in the case where the developed image support layer 105 contains atoms of Group III element, the amount of the atoms is desired to be controlled to an amount corresponding to one tenth of the amount of atoms of Group III element contained in the latent image support layer 104.

As for the developed image support layer 105, it is particularly important to be so designed to have a specific resistance of $10^{12}$ to $10^{16}$ Ω.cm with a view of preventing the light receiving member from being negatively affected by changes in environmental condition and stably maintaining the electrophotographic characteristics so as to always provide high quality copied images. To control the specific resistance of the developed image support layer 105 to be in the above range can be carried out by adjusting the composite ratio of the constituents thereof to a predetermined value by controlling the flow ratio of the film-forming raw materials upon formation thereof.

The charge injection inhibition layer 106 is formed of a-Si(H,X)(C,M')(N,O) as described above, and it is desired to be 0.03 to 15 μm thick.

The IR absorptive layer 107 is formed of a-Si(Ge,Sn)(H,X)(C,M')(N,O) as described above, and it is desired to be 0.05 to 25 μm thick.

In any of the above cases, the halogen atoms (X) can include fluorine, chlorine, bromine and iodine. Among these halogen atoms, fluorine and chlorine are particularly desirable. Likewise, the foregoing Group III element can include B (boron), Al (aluminum), Ga (gallium), In (indium) and Tl (thallium). Among these elements, B, Al and Ga are particularly preferred. The foregoing Group V element can include P (phosphorus), As (arsenic) , Sb (antimony) and Bi (bismuth). Among these elements, P and As are particularly preferred. Then, the foregoing Group VI element can include S (sulfur), Se (selenium), Te (tellurium) and Po (polonium). Among these elements, S and Se are particularly preferred.

The method of preparing the light receiving member to be used in the present invention will be explained.

Each of the foregoing layers to constitute the light receiving layer 102, 102' or 102'' of the light receiving member may be properly formed by any of the known vacuum deposition methods wherein film-forming parameters are properly designed. Specifically, there can be mentioned glow discharge method such as AC glow discharge PCVD method i.e. low frequency PCVD method, high frequency PCVD method and microwave PCVD method and DC glow discharge PCVD method; ECR PCVD method; reactive sputtering method; thermal induced CVD method; ion plating method; and light induced CVD method. Other than these methods, there can be also mentioned HR-CVD method (Hydrogen-Radical Assisted Chemical Vapor Deposition method) and FO-CVD method (Fluorine-Oxidation chemical vapor deposition method).

The HR-CVD method denotes a method that an active species (A) formed from a raw material gas such as hydrogen gas and another active species (B) reactive with said active species (A) which is formed from a film-forming raw material gas are separately introduced into a film forming space and said active species (B) is reacted with said active species (A) to thereby deposit a film on a substrate being maintained at a desired temperature. The FO-CVD method denotes a method that a film forming raw material gas and a halogen gas capable of oxidizing said film forming raw material gas are separately introduced into a film forming space and said film forming raw material gas is reacted with said halogen gas to thereby deposit a film on a substrate being maintained at a desired temperature.

These film forming methods may be selectively employed depending on the factors such as the manufacturing conditions, the installation cost required, production scale and properties required for the light receiving member to be prepared. The glow discharge method, reactive sputtering method, ion plating method, HR-CVD method and FO-CVD method are suitable since the controls in the conditions upon forming the layers having desired properties are relatively easy, and hydrogen atoms, halogen atoms and other atoms can be easily introduced together with silicon atoms into a film to be deposited. And these film forming methods may be used together in one identical system.

In the following, the case of preparing the light receiving member to be used in the present invention by means of a high frequency PCVD method (that is, RF-PCVD method will be explained).

Figure 5:
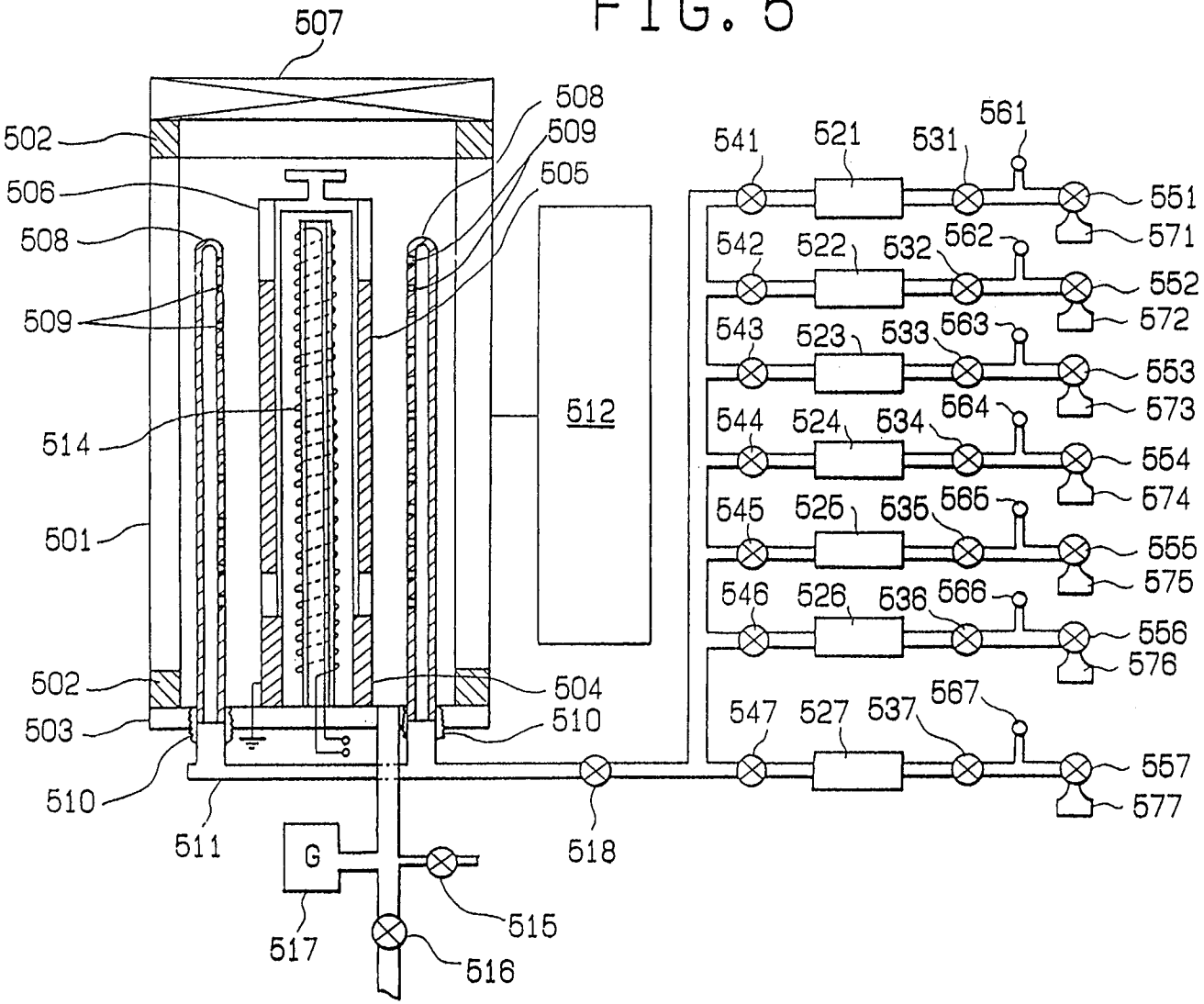
FIG. 5 is a schematic explanatory view of a fabrication apparatus for preparing an amorphous silicon light receiving member to be used in the present invention.

For practicing the RF-PCVD method, there can be used an appropriate RF-PCVD apparatus having the constitution as shown in FIG. 5.

Referring to FIG. 5, gas reservoirs 571, 572, 573, 574, 575, 576 and 577 are charged with gaseous starting materials for forming the respective layers to constitute the light receiving layer 102, 102' or 102" of the light receiving member to be used in the present invention, that is, for instance, $SiH_4$ gas in the reservoir 571. $H_2$ gas in the reservoir 572 $CH_4$ gas in the reservoir 573 $PH_3$ gas diluted with $H_2$ gas (hereinafter referred to as "$PH_3/H_2$ gas") in the reservoir 574, $B_2H_6$ gas diluted with $H_2$ gas (hereinafter referred to as "$B_2H_6/H_2$ gas") in the reservoir 575, NO gas in the reservoir 576 and Ar gas in the reservoir 577.

Numeral references 561, 562, 563, 564, 565, 566 and 567 stand for pressure gauges for the respective gases in the pipe ways from the reservoirs 571 through 577.

Prior to the entrance of these gases into a film forming chamber 501, it is confirmed that valves 551 through 557 for the gas reservoirs 571 through 577 and a leak valve 515 are closed and that inlet valves 531 through 537, exit valves 541 through 547, and a sub-valve 518 are opened. Then, a main valve 516 is at first opened to evacuate the inside of the film forming chamber 501 and the insides of gas pipe ways by a vacuum pump (not shown).

Then, upon observing that the reading on a vacuum gage 517 becomes a predetermined vacuum degree, the sub-valve 518 and the exit valves 541 through 547 are closed.

Now, in the film forming chamber 501, a cylindrical substrate 505 on which a film is to be formed is placed on a rotatable cylindrical substrate holder 506 having an electric heater 514 therein. Further, in the film forming chamber 501, there are longitudinally installed a plurality of gas feed pipes 508 each provided with a plurality of gas liberation holes 509 capable of uniformly supplying a film forming raw material gas toward the cylindrical substrate 505. Each of the gas feed pipes 508 is connected through a detachable sealing means 510 provided with a bottom wall 503 of the film forming chamber 501 to a gas supply pipe 511 connected to each of the gas reservoirs 571 through 577.

The film forming chamber 501 is so designed that the circumferential wall can serve as a cathode. Likewise, the cylindrical substrate holder 506 having the cylindrical substrate 505 being placed thereon is so designed that it can serve as an anode. For this purpose, the circumferential wall of the film forming chamber 501 is electrically insulated by an insulator 502. Numeral reference 512 stands for a matching box connected to a RF power source (not shown). When the RF power source is switched on to generate a RF power, the RF power is applied through the matching box 512 between the circumferential wall (cathode) of the film forming chamber 501 and the cylindrical substrate holder 506 having the cylindrical substrate 505 thereon (anode) to thereby cause RF glow discharge in the film forming chamber 501.

Prior to starting film formation, the exit valve 547 and the sub-valve 518 are gradually opened to supply Ar gas into the film forming chamber 501 through the gas liberation holes 509 of the gas feed pipes 508. The flow rate of Ar gas is controlled to a predetermined value by means of a mass flow controller 527. The gaseous pressure (inner pressure) of the film forming chamber 501 is adjusted to a predetermined value by regulating the vacuum pump and the main valve 516 while observing the reading on the vacuum gage 517. Then, the cylindrical substrate 506 starts rotating and it is heated to and maintained at a predetermined temperature by actuating the electric heater 514. Thereafter, the supply of Ar gas into the film forming chamber 501 is terminated by closing the exit valve 547 and the subvalve 518.

After this, the formation of a constituent layer of the light receiving layer 102, 102' or 102" of the light receiving member is carried out, for example, in the following way. That is, one or more kinds of raw material gases are introduced into the film forming chamber 501 by opening the correspondents of the exit valves 541 through 547 and the sub-valve 518, and the respective flow rates of the raw material gases are adjusted as desired by the correspondents of mass flow controllers 521 through 527 in the same manner as in the above case of Ar gas.

The gaseous pressure (inner pressure) of the film forming chamber 501 is adjusted as desired by regulating the vacuum pump and the main valve 516 while observing the reading on the vacuum gage 517.

After all the flow rates of raw material gases and the inner pressure became stable, a predetermined RF power is applied through the matching box 512 into the film forming chamber 512 to cause RF glow discharge, whereby a deposited film is formed on the cylindrical substrate 505 being maintained at a desired temperature.

When the constituent layer of a desired thickness ms formed, the exit valves and the sub-valve are closed. A successive constituent layer is formed by repeating the above procedures. In any case, when the constituent layer is formed, the respective flow rates of the raw material gases are controlled by using a microcomputer or the like so that the gaseous pressure of the film forming chamber can be stabilized to ensure stable film forming conditions.

All of the exit valves other than those required for upon forming the respective layers are of course closed. Further, upon forming the respective layers, the inside of the system is once evacuated to a high vacuum degree as required by closing the exit valves 541 through 547 while opening the sub-valve 518 and fully opening the main valve 516 in order to prevent the gases used for the previous layer to be left in the film forming chamber 501 and also in the gas pipe ways.

In order to form a desirable layer of uniform thickness on the cylindrical substrate 505, it is possible to rotate the cylindrical substrate 505 during the layer formation by rotating the cylindrical substrate holder 506 by a motor (not shown).

Developer (insulating toner)

As described above, in the present invention, there is used a fine particle insulating toner having a volume average particle size of 4.5 to 9 μm and an apparent viscosity of $1\times10^4$ to $2\times10^5$ poise at 100° C. which can be melted at a low temperature and completely fused within a narrow range of temperature (fine particle insulating sharp melt toner).

The fine particle insulating sharp melt toner to be used in the present invention contains an appropriate binder resin.

Examples of such binder resin are, for example, homopolymers of styrene and its derivatives such as polystyrene, chloropolystyrene, poly-α-methylstyrene; styrene copolymers such as styrene-chlorostyrene copolymer, styrene-propylene copolymer, styrene-butadiene copolymer, styrene-vinyl chloride copolymer, styrene-vinyl acetate copolymer and styrene-maleic acid copolymer; styrene-acrylic ester copolymers such as styrene-methyl acrylate copolymer, styrene-ethyl acrylate copolymer, styrene-butyl acrylate copolymer, styrene-octyl acrylate copolymer and styrene phenyl acrylate copolymer; styrene-methacrylic ester copolymers such as styrene-methyl methacrylate copolymer, styrene-ethyl methacrylate copolymer, styrene-butyl methacrylate copolymer and styrene-phenyl methacrylate copolymer; styrene-α-methyl chloroacrylate; styrenic resins such as styrene-chloro-acrylonitrile-acrylic ester copolymer; vinyl acetate resins; rosin-modified maleic resins; phenolic resins; epoxy resins; polyester resins; low molecular weight polyethylene resins; low molecular weight polypropylene resins; silicone resins; ketone resins; ethylene-ethyl acrylate copolymer; xylene resins; polyvinylbutyral resins, etc.

Of these polymers and resins, practically desirable examples are styrene acrylic ester system copolymers and polyester resins.

Particularly desirable examples of the above binder resin are polyester resins comprising condensation products of a bisphenol derivative represented by the following structural formula (I) or a substituted compound thereof as a diol component and a charboxylic component selected from the group consisting of acids having two or more carboxylic groups such as fumaric acid, maleic acid, phthalic acid, terephthalic acid, trimellitic acid and pyromellitic acid, anhydrides of said acids, and lower alkyl esters of said acids.

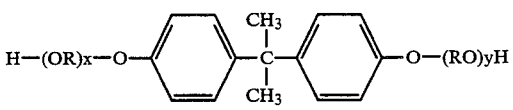

(I)

(wherein R is an ethylene group or a propylene group, x and y are respectively an integer of 1 or more, and x+y=2 to 10 in a mean value.)

The fine particle insulating toner to be used in the present invention may be either magnetic or non-magnetic. The magnetic fine particle insulating toner can be properly produced by blending one or more necessary components and magnetic powder in the foregoing binder resin by a conventional toner producing method. As the magnetic powder, there can be mentioned, for example, magnetic powders of non-oxidized iron, iron having a oxidized surface, ferrite, nickel, copper, rare earth metals, alloys of two or more these metals or oxides of these metals.

Basically, the fine particle insulating toner to be used in the present invention is produced by blending a proper colorant in the foregoing binder resin. As the colorant, a known dye and/or pigment may be used. Usable as the dye are, for example, basic dyes, oil soluble dyes, etc. Usable as the pigment are, for example, diazo-yellow compounds, insoluble azo compounds, copper phthalocyanines, etc.

Other than these colorants, any of the above-mentioned magnetic powders which are capable of functioning as the colorant can be selectively used also as the colorant.

Specific examples of the usable dye to be contained in the fine particle insulating toner which is used in the present invention are C.I. Solvent Red 49, C.I. Solvent Red 52, C.I. Solvent Red 109, C.I. Basic Red 12, C.I. Basic Red 1, and C.I. Basic Red 36.

Specific examples as the usable pigment to be contained in the fine particle insulating toner to be used in the present invention are C.I. Pigment Yellow 17, C.I. Pigment Yellow 15, C.I. Pigment Yellow 13, C.I. Pigment Yellow 14, C.I. Pigment Yellow 12, C.I. Pigment Red 5, C.I. Pigment Red 3, C.I. Pigment Red 2, C.I. Pigment Red 6, C.I. Pigment Red 7, C.I. Pigment Blue 15, and C.I. Pigment Blue 16.

Specific examples of the copper phthalocyanine are copper phthalocyanine Ba salts having 2 or 3 carboxybenzamidomethyl group substituents on the phthalocyanine nucleus which are represented by the following structural formula (II).

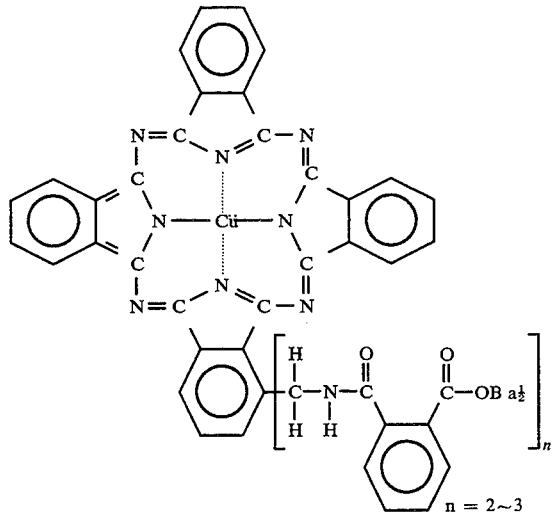

The fine particle insulating toner to be used in the present invention may contain one or more optional additives such as charging state controlling agent, lubricant, abrasive, flowability improver, etc.

In any case, the fine particle insulating toner to be used in the present invention is required to be such that has a volume average particle size of 4.5 to 9 μm and an apparent viocosity of $1\times10^4$ to $2\times10^5$ poise at 100° C. which can be melted at low temperature and completely fused within a narrow range of temperature. The use of this toner in combination with the foregoing specific light receiving member results in improving the fixing property, high-temperature resistant offset property and toner mixing efficiency to provide a desirable full color pictorial image.

The measurement of the apparent viscosity in the preparation of the fine particle insulating toner to be used in the present invention is carried out by using a Flow Tester CFT-500 (product by Shimazu Seisakusho Ltd.) That is, about 1.0 to 1.5 g of a run specimen of 60 mesh is taken out, it is pressed with a load of 100 kg/cm$^2$ by using a molding device and the resultant pressed sample is subjected to the measurement by the above Flow Tester at normal temperature and normal humidity under the below-mentioned conditions, to thereby obtain a curve relating to apparent viscosity (smooth curve).

| | | |
|---|---|---|
| RATE TEMP | 6.0 | D/M (°C., one minute) |
| SET TEMP | 70.0 | DEG (°C.) |
| MAX TEMP | 200.0 | DEG |
| INTERVAL | 3.0 | DEG |
| PREHEAT | 300.0 | SEC (sec.) |

-continued

| | |
|---|---|
| LOAD | 20.0 KGF (kg) |
| DIE (DIA) | 1.0 MM (mm) |
| DIE (LENG) | 1.0 MM |
| PLUNGER | 1.0 $CM^2$ ($cm^2$) |

An apparent viscosity at 100° C. is obtained from the smooth curve and it is made to be the viscosity of the specimen against the temperature.

In order to make the fine particle insulating toner to be of an apparent viscosity of $1\times10^4$ to $2\times10^5$ poise, the foregoing binder resin and various additives as required are properly selected and they are blended while conducting the above measurement of apparent viscosity aiming at attaining the above range of apparent viscosity and based on the results, the kind of the binder resin and the kinds of various additives as required to be used, and the blending ratio of them are decided.

The fine particle insulating toner to be used in the present invention may be properly produced by a conventional toner producing method wherein a proper mixture from which the fine particle insulating toner is obtained is prepared, and the mixture is subjected to grinding granulation. The foregoing mixture may be properly prepared also by a conventional method, for example, a method wherein components are dispersed in a binder resin solution and the resulting liquid is spray-dried or a method wherein an emulsion containing monomers capable of forming a binder resin and components required is firstly prepared, the emulsion is subjected to polymerization and the resultant is spray-dried. Other than these method, the fine particle insulating toner to be used in the present invention can be also prepared by a method wherein toner microcapsules each comprising a core material and a shell material are prepared, they are spray-dried, followed by classification.

In the following, examples for producing the fine particle insulating toner will be described.

The following examples are provided for illustrative purposes only and are not intended to limit the scope of the present invention.

Unless otherwise indicated, parts and % signify parts by weight and % by weight respectively.

Toner Production Example 1

| | |
|---|---|
| Polyester resin obtained by subjecting bisphenol derivative having diol substituents and fumaric acid to condensation polymerization (as the binder resin) | 100 parts |
| Magnetite powder (as the colorant and also as the magnetic powder) | 60 parts |
| Nigrosine (as the charging state controlling agent) | 2 parts |
| Polypropylene (as the lubricant) | 3 parts |

The above ingredients were well blended in a Henschel mixer to obtain a mixture.

The mixture was melt-kneaded at 160° C. by means of a roll mill. The kneaded product was cooled, coarsely crushed to about 1 to 2 mm particle size by means of a hamer mill, then finely pulverized to about 40 μm or less particle sizes by means of a pulverizer using jet air stream and classified by using a MICROPLEX 400 MP classifier (product of ALPINE Co., Ltd.) wherein the system was so adjusted that particles of exceeding 9 μm in particle size were cut off. The classified fine particles obtained by the above first classification were again classified by using a MICROPLEX 132 MP classifier (product of ALPINE Co., Ltd.) wherein the system was so adjusted that particles of less than 4.5 μm in particle size were cut off, whereby toner fine particles of 4.5 to 9 μm in volume average particle size were obtained.

As a result of examining the apparent viscosity at 100° C. of the resultant toner fine particles by the foregoing apparent viscosity measuring method, they were of about $3\times10^4$ poise.

Toner Production Example 2

There were prepared four kinds of fine particle color toners having a volume average particle size of 4.5 to 9 μm and an apparent viscosity at 100° C. of $1\times10^4$ to $2\times10^5$ in the undermentioned manner wherein as the binder resin, there was used 100 parts of polyester resin obtained by subjecting propoxy hisphenol derivative and fumaric acid, and as the other ingredients, there were used the respective colorants and charging state controlling agents in respective amounts shown in Table 1.

That is, in each case, the binder resin, the colorant and the charging state controlling agent were well blended in a Henshel mixer to obtain a mixture. The mixture was twice melt-kneaded by means of a three-roll mill. The kneaded product was cooled, coarsely crushed to about 1 to 2 mm particle size by means of a hammer mill, then finely pulverized to about 40 μm or less particle sizes by means of a pulverizer using jet air stream and classified by using a MICROPLEX 400 MP classifier (product of ALPINE Co., Ltd.) wherein the system was so adjusted that particles of exceeding 9 μm in particle size were cut off. The classified fine particles obtained by the above first classification were again classified by using a MICROPLEX 132 MP classifier (product of ALPINE Co., Ltd.) wherein the system was so adjusted that particles of less than 4.5 μm in particle size were cut off, whereby toner fine particles of 4.5 to 9 μm in volume average particle size were obtained.

To 100 parts of the toner fine particles thus obtained, 0.5 parts of finely powdered silica treated with hexamethyldisilazane was additionally added to thereby obtain color toner fine particles. Thus, there were obtained four kinds of color toners. Then, as the flowability improver, there was provided Cu-Zn-Fe system ferrite carrier mean (particle size: 48 μm, 250 mesh pass and 350 mesh on: 85% by weight, true density: 4.5 $g/cm^3$) coated with about 5% of a mixture composed of vinylidenefluoride/tetrafluoroethylene copolymer (copolymerized ratio of 8:2) and styrene/2-ethylhexyl acrylate/methyl methacrylate copolymer (copolymerized ratio of 45:20:35) in a quantitative ratio of 50:50.

To 8 to 12 parts of each of the foregoing four color toners, the foregoing flowability improver was added in amount that the total amount became 100 parts, and they were well mixed to thereby obtain a developer.

In this way, there were obtained four kinds of developers.

Toner Production Example 3

100 parts of styrene acrylic resin as the binder resin, 3 parts of C.I. Pigment Red 5 as the colorant and 3.5 parts of Cr salycylate complex as the charging state controlling agent were well blended to obtain a mixture, and the mixture was introduced into toluene to obtain a microcapsule dispersion containing 10% of solid materials (core materials). The microcapsule dispersion was introduced into a niroatomizer having two nozzles (product by Ashizawa Tekkojo Kabushiki Kaisha), wherein it was spray-dried by using a hot air of 100° C. and at a pressure of 4 kg/cm$^2$ to obtain toner microcapsules. The particle sizes of the toner microcapsules thus obtained were measured by a coulter counter 100 μm in aperture size and as a result, it was found that they were in the range of 0.1 to some hundreds μm. The toner microcapsules were classified by the foregoing MICROPLEX 400 MP classifier then the foregoing MICROPLEX 132 MP classifier in the same manner as in Toner Production Example 1, to thereby obtain toner fine particles of 4.5 to 9 μm volume average particle size.

As a result of examining the resultant toner fine particles by the foregoing apparent viscosity measuring method, they were of about $3\times10^4$ poise at 100° C.

Then, as the flowability improver, there was provided Cu-Zn-Fe system ferrite carrier (mean particle size: 48 μm, 250 mesh pass and 350 mesh on: 89% by weight, true density: 4.5 g/cm$^3$) coated with about 5% of a mixture composed of vinylidenefluoride/tetrafluoroethylene copolymer (copolymerized ratio of 8:2) and styrene/2-ethylhexyl acrylate/methyl methacrylate (copolymerized ratio of 45:20:35).

To 10 parts of the foregoing toner fine particles, the flowability improver was added in an amount that the total amount became 100 parts, they were well mixed to thereby obtain a developer.

Image-forming Method

Figure 2:
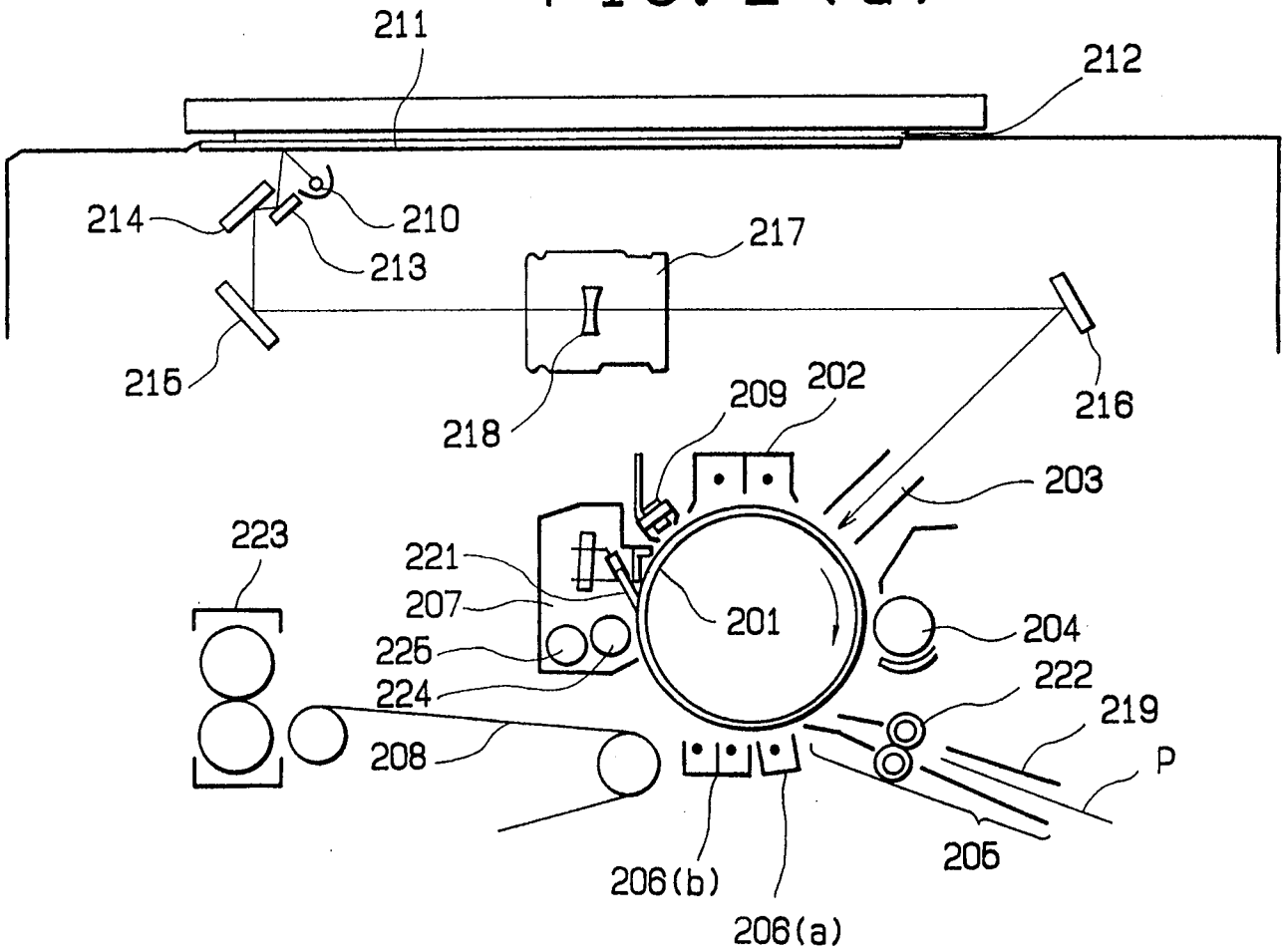
FIGS. 2(A) and 2(B) are schematic explanatory views respectively illustrating the constitution of an electrophotographic copying system which is suitable for practicing the image-forming method according to the present invention.
Figure 2B:
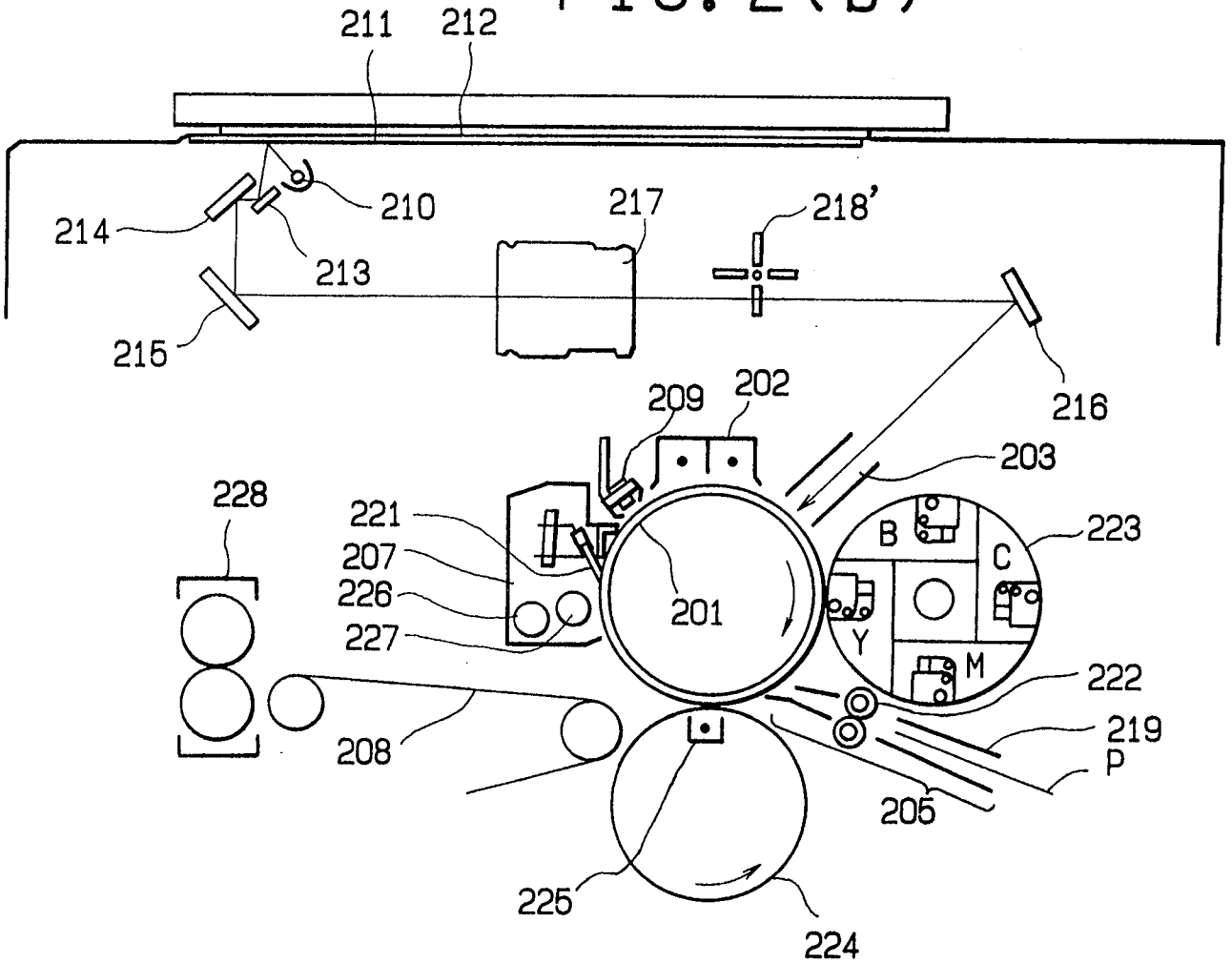

The electrophotographic image-forming method according to the present invention can be practiced in an appropriate electrophotographic copying system having the constitution, for example, as shown in FIG. 2(*a*) or FIG. 2(*b*).

Figure 4:
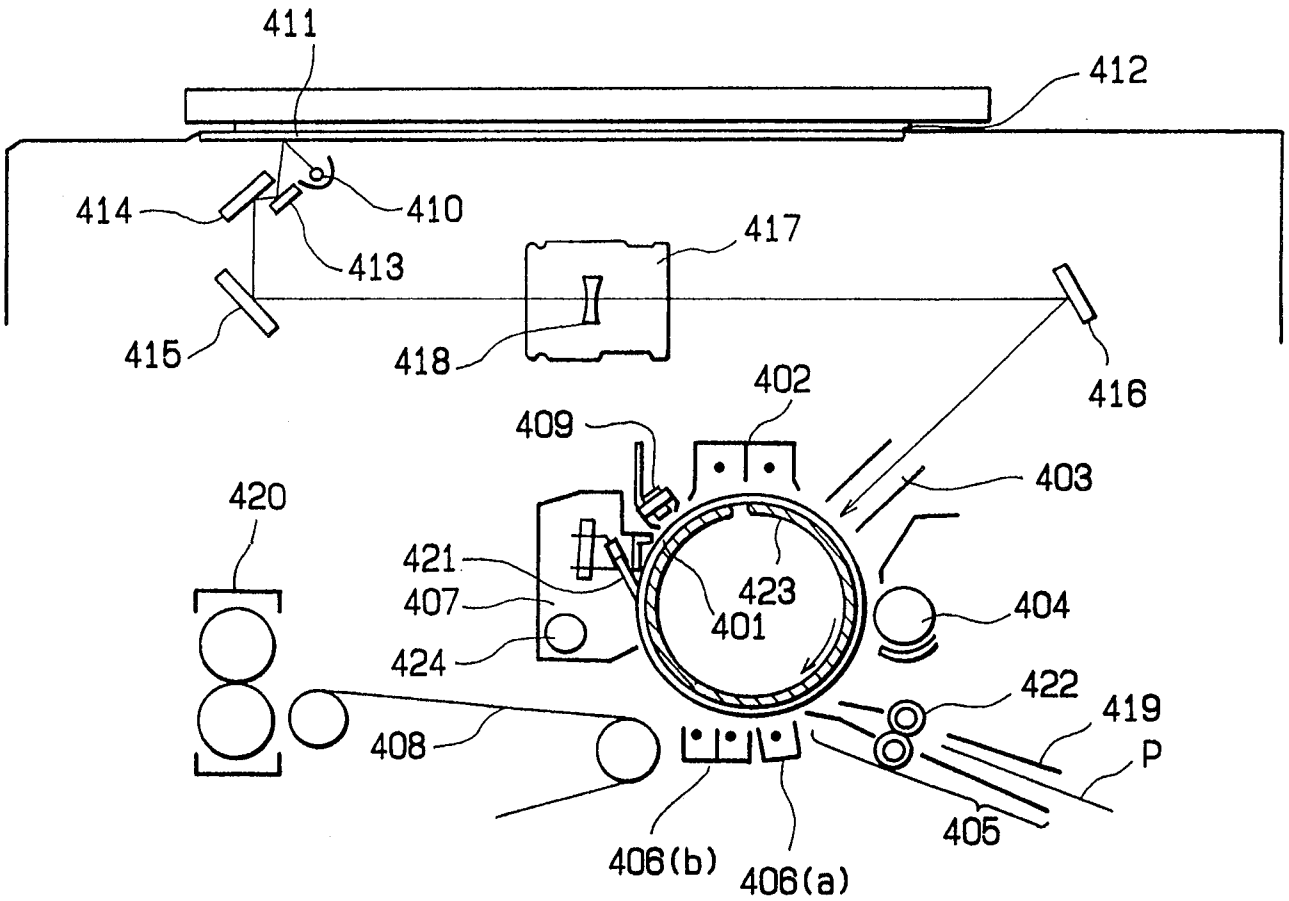
FIG. 4 is a schematic explanatory view illustrating the constitution of a conventional electrophotographic copying system.

The constitution of the electrophotographic copying system shown in FIG. 2(*a*) is the same as that of the electrophotographic copying system shown in FIG. 4, except that the former is provided with a magnetic roller 224 in the cleaning mechanism, a specific amorphous silicon light receiving member 201 according to the present invention and a development mechanism 204 charged with a specific fine particle insulating toner according to the present invention, and not provided with any heater for the light receiving member.

Anyway, as shown in FIG. 2(*a*), near the cylindrical amorphous silicon light receiving member 201 having the configuration shown FIG. 1 which rotates in the direction indicated by an arrow, there are provided a main corona charger 202, an electrostatic latent image-forming mechanism 203, the development mechanism 204 charged with the fine particle insulating toner having a volume average particle size of 4.5 to 9 μm and an apparent viscosity at 100° C. of $1\times10^4$ to $2\times10^5$ poise, a transfer sheet feeding mechanism 205, a transfer charger 206(*a*), a separating charger 206(*b*), a cleaning mechanism 207, a transfer sheet conveying mechanism 208, a charge-removing lamp 209 and a fixing mechanism 223.

The foregoing cylindrical amorphous silicon light receiving member 201 is uniformly charged by the main corona charger 202 to which a predetermined voltage is impressed. Then, an original 212 to be copied which is placed on a contact glass 211 is irradiated with a light from a light source 210 through the contact glass 211 and the resulting reflected light is projected through mirrors 213, 214 and 215, a lens system 217 containing a filter 218, and a mirror 216 onto the surface of the cylindrical amorphous silicon light receiving member 201 to form an electrostatic latent image corresponding to the original 212.

This electrostatic latent image is developed with the foregoing fine particle insulating toner supplied by the development mechanism 204 to provide a toner image. A transfer sheet P is supplied through the transfer sheet feeding mechanism 205 comprising a transfer sheet guide 219 and a pair of feed timing rollers 222 so that the transfer sheet P is brought into contact with the surface of the cylindrical amorphous silicon light receiving member 201, and corona charging is effected with the polarity different to that of the said toner from the rear of the transfer sheet P by the transfer charger 206(*a*) to which a predetermined voltage is applied in order to transfer the toner image onto the transfer sheet P. The transfer sheet P having the toner image transferred thereon is electrostatically removed from the cylindrical amorphous silicon light receiving member 201 by the charge-removing action of the separating corona charger 206(*b*) where a predetermined AC voltage is impressed, then conveyed by the transfer sheet conveying mechanism 208 to the fixing mechanism 223 containing a pair of heat rollers and a mechanism to supply toner offset-preventing oil to each of the rollers not shown) where the toner image on the transfer sheet P ms fixed, and taken out from the system.

The cylindrical amorphous silicon light receiving member 201 arrives at the cleaning mechanism 207 comprising a cleaning blade 221, the magnetic roller 224 and a feedscrew 225, where magnetic particles contained in the residual toner on said light receiving member are firstly removed by the action of the toner brush formed on the magnetic roller 224, then said light receiving member is polished by the cleaning blade 221 to thereby remove other remaining materials on the surface thereof without the surface layer of the cylindrical amorphous silicon light receiving member 201 being worn.

The thus removed magnetic materials and other materials are discharged through the feedscrew 225.

Thereafter, the cylindrical amorphous silicon light receiving member 201 thus cleaned with its surface is entirely exposed to light by the charge-removing lamp 209 to erase the residual charge and is recycled.

The above magnetic roller 224 to be provided in the cleaning mechanism 207 comprises a spindle made of a metal such as aluminum, the surface of which being coated with magnetic ferrite materials by a conventional method or being coated a composition composed of a binder resin and magnetic ferrite powder by applying an emulsion containing said binder resin and magnetic ferrite powder onto said surface by means of an injection moulder. The magnetic force at the surface of the magnetic roller is desired to be 900 to 1000 Gauss.

The electrophotographic copying system shown in FIG. 2(*b*) is particularly suitable for practicing the electrophotographic image-forming method for obtaining full color pictorial copied images.

The electrophotographic copying system shown in FIG. 2(*b*) is of the same constitution as that shown in FIG. 2(*a*), except that the development mechanism 204 in FIG. 2(*a*) is replaced by a development unit 223 comprising four development mechanisms: a development mechanism Y charged with yellow toner; a development mechanism M charged with magenta toner; a development mechanism C charged with cyanic toner; and a development mechanism B charged with black toner, the transfer charger 206(*a*) and the separating corona charger 206(*b*) in FIG. 2(*a*) are replaced by a transfer drum 224 including a transfer charger 225, and the filter 218 in FIG. 2(*a*) is changed to a rotatable filter 218' of the configuration as shown in FIG. 2(*b*) which comprises four filters: a blue filter, a green filter, a red filter and a color correction filter. The filter 218' is so designed that it can be rotated by means of a rotating means (not shown) to selectively use a proper filter depending upon the kind of the developer to be used.

The image-forming method in the electrophotographic copying system shown in FIG. 2(*b*) is practiced in the same manner as in the case of that practiced in the electrophotographic copying system shown in FIG. 2(*a*), except that the development unit 223 is rotated by means of a rotating means (not shown) such that image development is conducted by using a proper development mechanism containing a developer corresponding to the color filter of the rotatable filter 218' to be used; and the transfer drum 224 is rotated in the direction indicated by an arrow to wind a transfer sheet P thereon where a toner image is transferred onto the transfer sheet P, followed by fixing.

Experiment 1

There were prepared ten cylindrical light receiving member samples of the configuration shown in FIG. 1(B) which comprises a cylindrical substrate 101 and a light receiving layer 102', said light receiving layer comprising a charge injection inhibition layer 106, a photoconductive layer 103, a latent image support layer 104 and a developed image support layer 105 being laminated in this order on the cylindrical substrate, in accordance with the foregoing layer forming manner by using the RF plasma CVD apparatus shown in FIG. 5 under the film forming conditions shown in Table 2, wherein as the cylindrical substrate 101, there was used an aluminum cylinder of 108 mm in outer diameter, 358 mm in length and 5 mm in thickness.

Separately, there were prepared a plurality of fine particle insulating toners each having a different volume average particle size at an interval of 1.5 um in the range of about 3 μm to about 12 μm by repeating the procedures of Tonor Production Example 1.

The electrophotographic image-forming method was carried out by setting each of the resultant cylindrical light receiving member samples to a modification of a commercially available CANON NP-7550 Electrophotographic Copying Machine for use in experimental purposes which has basically the same constitution as that shown in FIG. 2(*a*) and wherein the development mechanism being charged with each of the resultant fine particle insulating toners, and repeating the foregoing image-forming procedures using the electrophotographic image-forming system shown in FIG. 2(*a*)

In each case, images were reproduced to evaluate the resolution and tone reproduction in the interrelations among the cylindrical light receiving member sample used, its surface temperature upon image formation and the fine particle insulating toner used.

Figure 6:
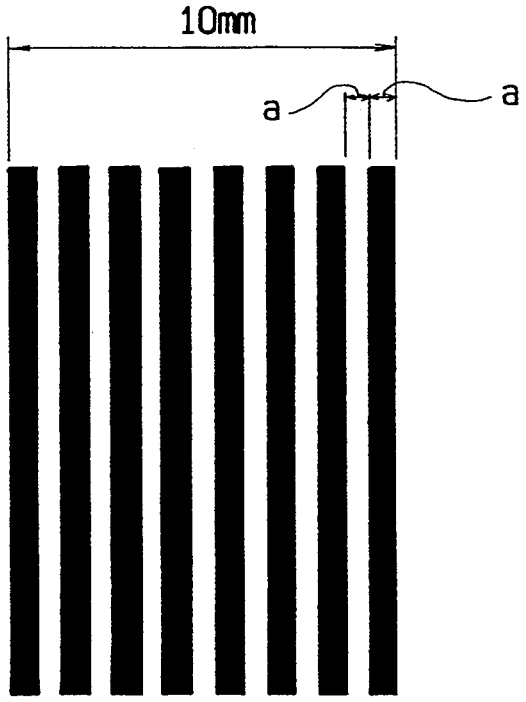
FIG. 6 is a schematic explanatory view of a resolution evaluating chart used in the later described experiments.

In the evaluation of the resolution, there was used a test chart having a plurality of black color portions of a regular width a and a plurality of white color portions of a regular width a being arranged alternately and regularly as shown in FIG. 6. Each width a of the white color portion between each pair of the black color portions on the test chart was narrowed and the test chart was subjected to reproduction, to thereby evaluate its minimum width a which can be resolved. That is, when each width a of the white color portion between each pair of the black color portions on the test chart is narrowed to a certain width or less and the test chart is subjected to reproduction, the resulting image becomes such that contains minute unforcused images the profiles of the adjacent black color proportions being overlapped. This case is meant that the resolution is practically impossible. For this reason, the width a of the white color portion when it makes impossible to resolve the image was made to be a value for the resolution.

In the evaluation of the tone reproduction, there was used a test chart on which three black solid circles respectively of 0.3, 0.5 and 1.1 in optical density are arranged. The test chart was subjected to reproduction such that a black solid circle image of 0.3 optical density and a black solid circle image of 1.1 optical density respectively corresponding to the original black solid circle of 0.3 optical density and the original black solid circle of 1.1 optical density were obtained.

And the evaluation of the tone reproduction was made based on the resultant image reproduced from the remaining original black solid circle of 0.5 in optical density. That is, the absolute value of a difference of optical density difference between the optical density of 0.5 for the original black solid circle and the optical density of the black solid circle image reproduced therefrom was made to be a value for the tone reproduction.

Figure 7A:
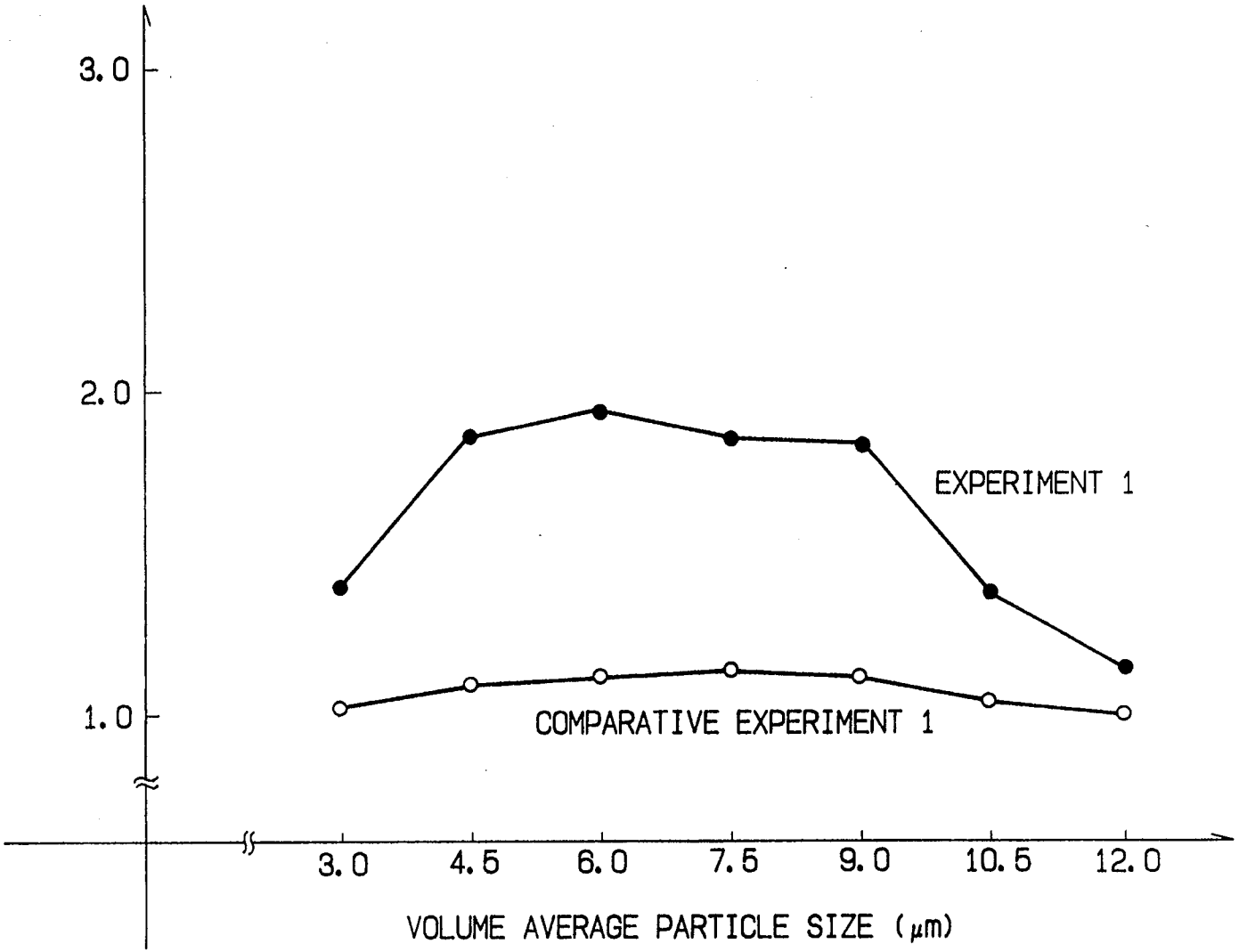
FIG. 7(A) shows graphs respectively illustrating the interrelations between the volume average particle sizes of toner and the resolutions obtained in the later described Example 1 and Comparative Example 1.
Figure 7B:
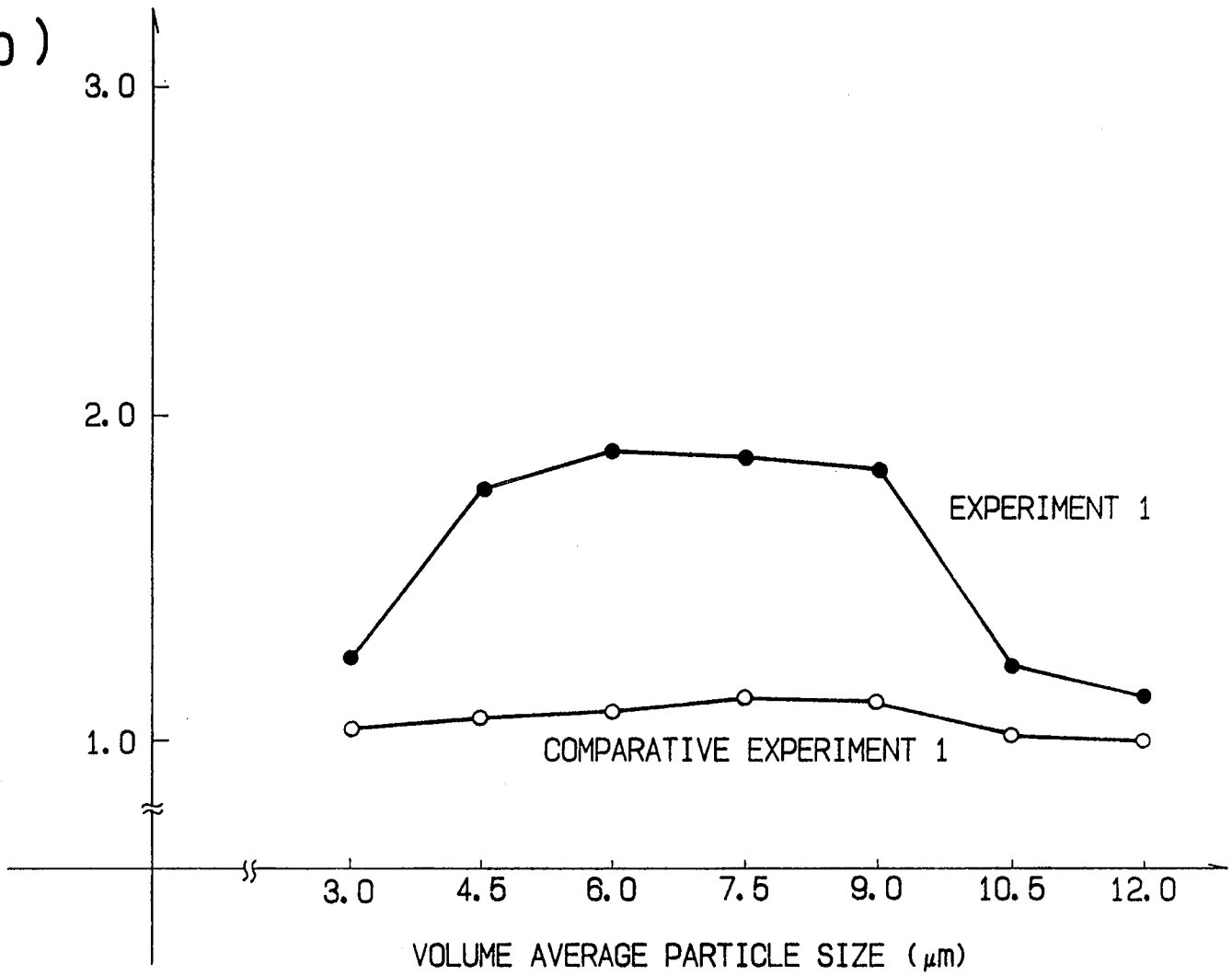
FIG. 7(B) shows graphs respectively illustrating the interrelations between the volume average particle sizes of toner and the tone reproductions obtained in the later described Example 1 and Comparative Example 1.

The evaluated results obtained with respect to the resolution were collectively shown in FIG. 7(*a*), wherein each of the values plotted is a mean value among the values obtained for the ten light receiving member samples.

The evaluated results obtained with respect to the none reproduction were collectively shown in FIG. 7(*b*), wherein each of the values plotted is a mean value among the values obtained for the ten light receiving member samples.

All the values plotted in each of FIGS. 7(*a*) and 7(*b*) are relative values obtained when the value for the resolution and the value for the tone reproduction obtained in the undermentioned Comparative Example 1 when the fine particle insulating toner of about 12 μm in volume average particle size was used.

Comparative Experiment 1

Figure 3:
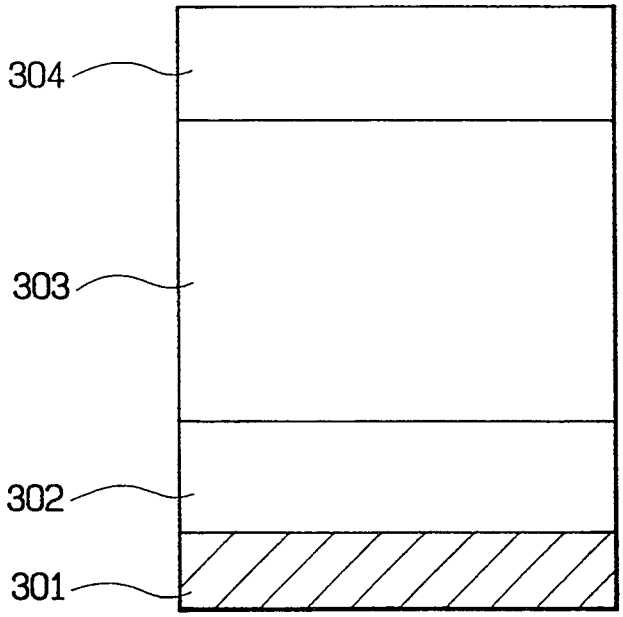
FIG. 3 is a schematic view illustrating the layer constitution of a conventional light receiving member.

There were prepared ten cylindrical light receiving member samples of the configuration shown in FIG. 3 for comparative purposes, each of which comprises a cylindrical substrate 301 and a light receiving layer comprising a charge injection inhibition layer 302, a photoconductive layer 303 and a surface layer 304 in accordance with the layer forming manner using the RF plasma CVD apparatus shown in FIG. 5 under the film forming conditions shown in Table 3. As the cylindrical substrate 301, there was used an aluminum cylinder of 108 mm in outer diameter, 358 mm in length and 5 mm in thickness.

Using each of the comparative light receiving member samples thus obtained, the electrophotographic image-forming process was carried out in the same manner as in Experiment 1. And evaluations of the resolution and tone reproduction were conducted in the same manner as in Experiment 1.

The evaluated results obtained were collectively shown in FIG. 7(*a*) (with respect to the resolution) and FIG. 7(*b*) (with respect to the tone reproduction).

Observations

From the results obtained in Experiment 1 and Comparative Experiment 1 which are shown in FIGS. 7(*a*) and 7(*b*), it has been recognized that when the specific amorphous silicon light receiving member according to the present invention is used in combination with the specific fine particle toner of about 4.5 to 9 μm in volume average particle according to the present invention, extremely high quality images excelling in both the resolution and the tone reproduction can be stably and repeatedly obtained.

Experiment 2 and Comparative Experiment 2

Evaluation on the tone reproduction was conducted.

Experiment 2

There were prepared ten amorphous silicon cylindrical light receiving member samples of the configuration shown in FIG. 1(B) in the same manner as in Experiment 1, except for using as the cylindrical substrate 101 an aluminum cylinder of 80 mm in outer diameter, 358 mm in length and 5 mm in thickness.

As the electrophotographic copying machine to be used for image evaluation, there was used a modification of a commercially available CANON Color Laser Copier PIXEL for use in experimental purposes which basically has the same constitution as that shown in FIG. 2(*b*).

As the four kinds of color toners, there were used those four kinds of color toners obtained in Toner Production Example 2. For each of the four kinds of color toners, there were provided three different fine particle color toners respectively having a volume average particle size of about 4.5 μm, about 6 μm, and about 9 μm. And for each of these three different color toners, there were provided five different fine particle color toners respectively having an apparent viscosity at 100° C. of about $5\times10^3$ poise, about $1\times10^4$ poise, about $6\times10^4$ poise, about $2\times10^5$ poise, and about: $2\times10^5$ poise.

The same evaluation procedures of the tone reproduction as in Example 1 were repeated wherein a CANON Test Sheet CA-4 was used.

Comparative Experiment 2

There were prepared ten amorphous silicon cylindrical light receiving member samples of the configuration shown FIG. 3 in the same manner as in Comparative Experiment 1, except for using as the cylindrical substrate 301 an aluminium cylinder of 80 mm in outer diameter, 358 mm in length and 5 mm in thickness.

Evaluation for the tone reproduction was conducted in the same manner as in Example 2.

Figure 8:
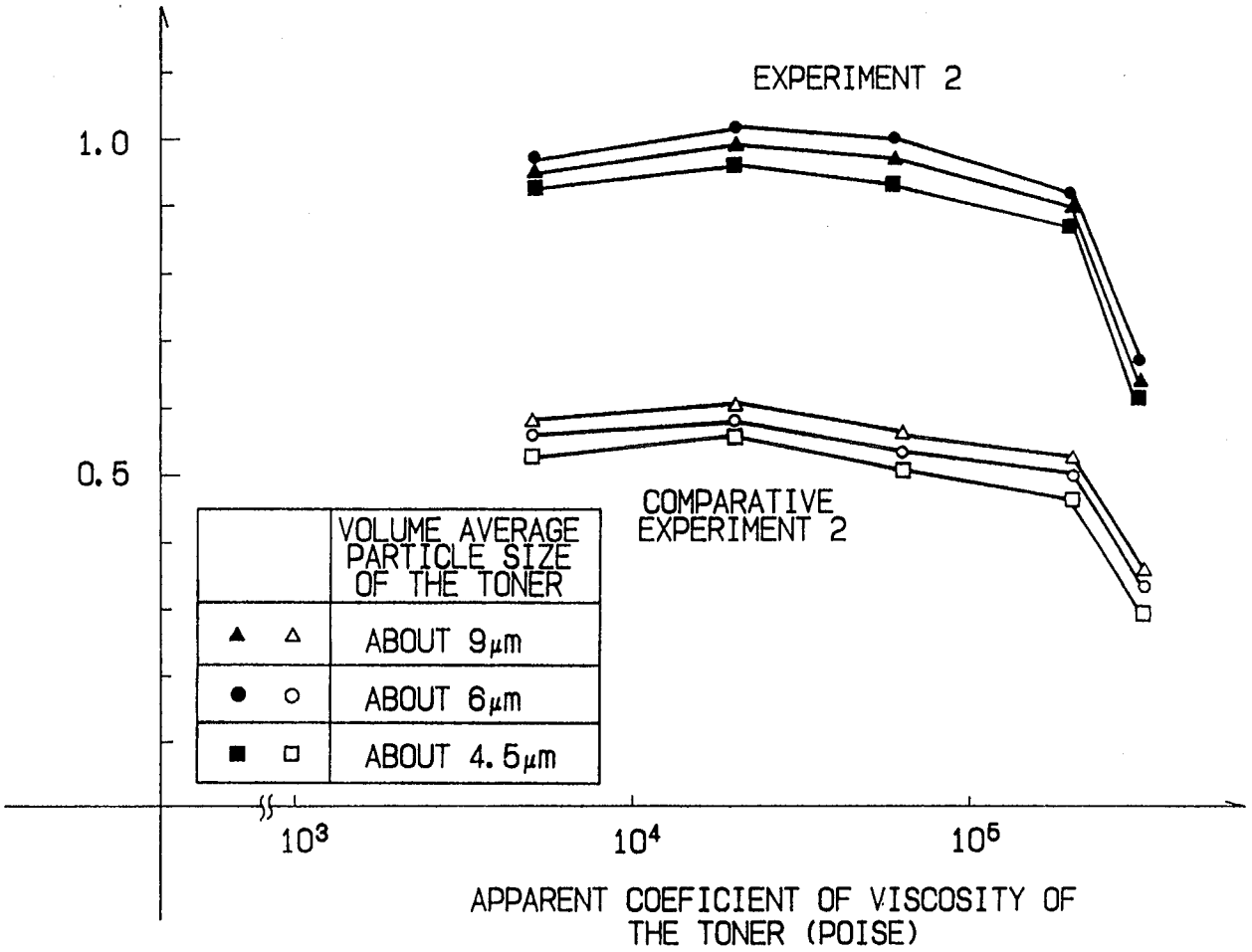
FIG. 8 shows graphs respectively illustrating the interrelations between the apparent viscosities of toner and the toner reproductions obtained in the later described Example 2 and Comparative Example 2.

The evaluated results obtained in Experiment 2 and Comparative Experiment 2 were collectively shown in FIG. 8 in the same manner as in the case of FIG. 7(*b*), wherein the values plotted are relative values obtained when the value obtained in the case where the fine particle color toner having an apparent viscosity at 100° C. of about $6\times10^4$ poise was used was made to be the control(l).

Observations

From the results obtained in Experiment 2 and Comparative Experiment 2, it has been found that when the specific amorphous silicon light receiving member according to the present invention is used in combination with the specific fine particle color toner having a volume average particle size of 4.5 to 9 μm and an apparent viscosity at 100° C. of $1\times10^4$ to $2\times10^5$ a plurality of the fine particle color toners are well melted and mixed to provide high quality full color pictorial copied images extremely excelling in the tone reproduction.

Experiment 3 and Comparative Experiment 3

Evaluation on the resolution was conducted.

Experiment 3

There were prepared ten amorphous silicon cylindrical light receiving member samples of the configuration shown in FIG. 1(B) in the same manner as in Experiment 1, except for using as the cylindrical substrate 101 an aluminum cylinder of 80 mm in outer diameter, 358 mm in length and 5 mm in thickness.

As the electrophotographic copying machine to be used for image evaluation, there was used a modification of a commercially available CANON Color Laser Copier PIXEL for use in experimental purposes which basically has the same constitution as that shown in FIG. 2(*b*).

As the four kinds of color toners, there were used those four kinds of color toners obtained in Toner Production Example 2. For each of the four kinds of color toners, there were provided three different fine particle color toners respectively having a volume average particle size of about 4.5 μm, about 6 μm, and about 9 μm. And for each of these three different color toners, there were provided five different fine particle color toners respectively having an apparent viscosity at 100° C. of about $5\times10^3$ poise, about $1\times10^4$ poise, about $6\times10^4$ poise, about $2\times10^5$ poise, and about $2\times10^5$ poise.

The same evaluation procedures of the resolution as in Example 1 were repeated wherein a CANON Test Sheet CA-4 was used.

Comparative Experiment 2

There were prepared ten amorphous silicon cylindrical light receiving members of the configuration shown in FIG. 3 in the same manner as in Comparative Experiment 1, except for using as the cylindrical substrate 301 an aluminum cylinder of 80 mm in outer diameter, 358 mm in length and 5 mm in thickness.

Evaluation for the resolution was conducted in the same manner as in Example 2.

Figure 9:
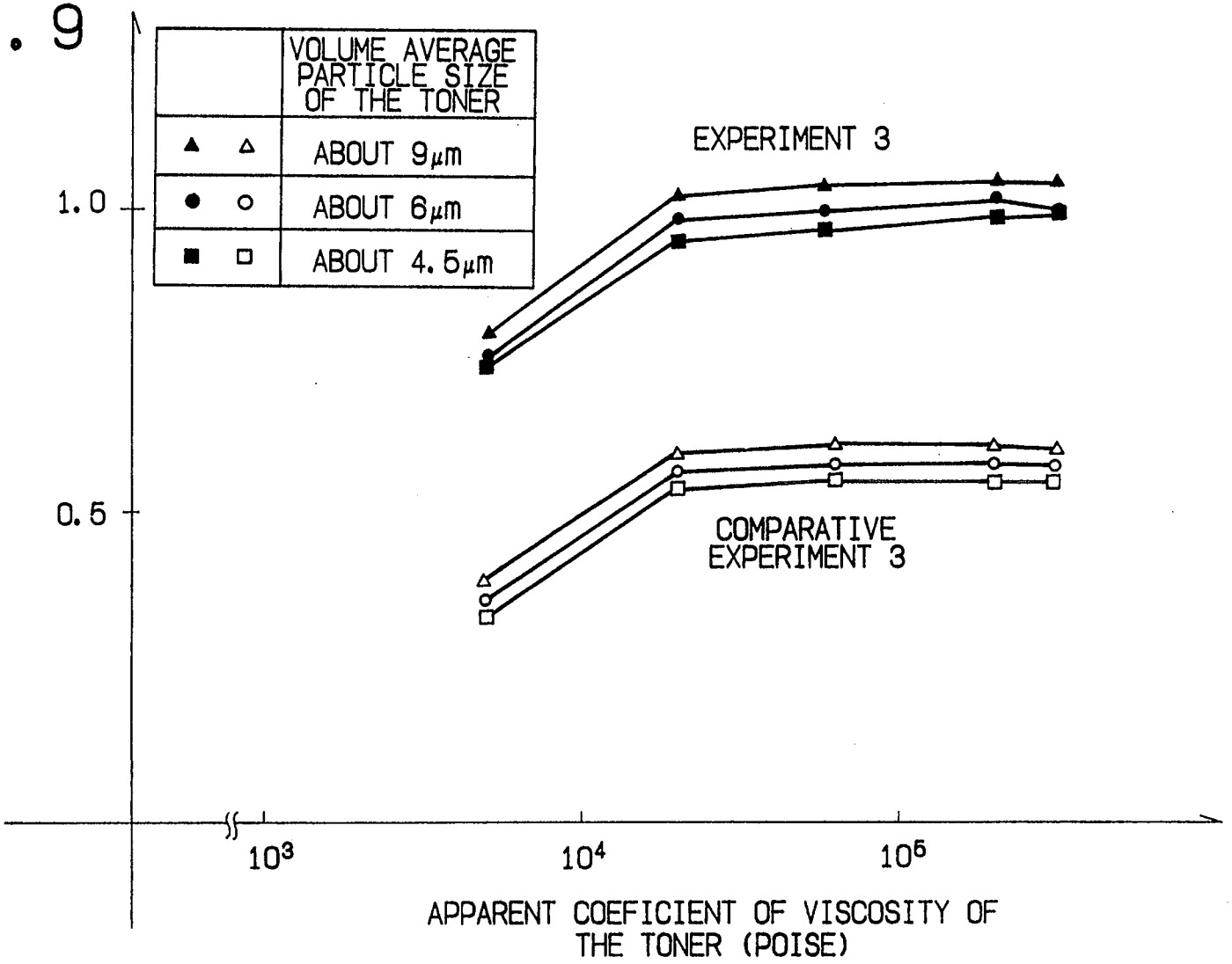
FIG. 9 shows graphs respectively illustrating the interrelations between the apparent viscosities of toner and the resolutions obtained in the later described Example 3 and Comparative Example 3.

The evaluated results obtained in Experiment 3 and Comparative Experiment 3 were collectively shown in FIG. 9 in the same manner as in the case of FIG. 7(*a*), wherein the values plotted are relative values obtained when the value obtained in the case where the fine particle color toner having an apparent viscosity at 100° C. of about $6\times10^4$ poise was used was made to be the control (1).

Observations

From the results obtained in Experiment 3 and Comparative Experiment 3, it has been found that when the specific amorphous silicon light receiving member according to the present invention is used in combination with the specific fine particle color toner having a volume average particle size of 4.5 to 9 μm and an apparent viscosity at 100° C. of $1\times10^4$ to $2\times10^5$, a plurality of the fine particle color toners are well melted and mixed to provide high quality full color pictorial copied images extremely excelling in the resolution.

Experiment 4 and Comparative Experiment 4

Evaluation was conducted on the situation of causing uneven image density due to stains adhered on the corona wires corresponding to the corona charger 202.

Experiment 4

There were prepared ten amorphous silicon cylindrical light receiving members of the configuration shown in FIG. 1(B) in the same manner as in Comparative Experiment 1, except for using as the cylindrical substrate 101 an aluminium cylinder of 80 mm in outer diameter, 358 mm in length and 5 mm in thickness.

As the electrophotographic copying machine to be used for image evaluation, there was used a modification of a commercially available CANON Color Laser Copier PIXEL for use in experimental purposes which basically has the same constitution as that shown in FIG. 2(*b*).

As the four kinds of color toners, there were used those four kinds of color toners obtained in Toner Production Example 2. For each of the four kinds of color toners, there were provided three different fine particle color toners respectively having a volume average particle size of about 4.5 μm, about 6 μm, and about 9 μm. And for each of these three different color toners, there were provided five different fine particle color toners respectively having an apparent viscosity at 100° C. of about $5\times10^3$ poise, about $1\times10^4$ poise, about $6\times10^4$ poise, about $2\times10^5$ poise, and about $2\times10^5$ poise.

The captioned evaluation was conducted by repeating the image-forming process in the foregoing laser copier to obtain full collor pictorial copied images with the use of a CANON Test Sheet BS-1 and observing the full collor pictorial images obtained by eyes to find the number of the copy on which uneven image density appeared. This number was made to be an evaluated value with respect to the evaluation item of uneven image density.

Comparative Experiment 4

There were prepared ten amorphous silicon cylindrical light receiving members of the configuration shown in FIG. 3 in the same manner as in Comparative Experiment 1, except for using as the cylindrical substrate 301 an aluminium cylinder of 80 mm in outer diameter, 358 mm in length and 5 mm in thickness.

Evaluation for the situation of uneven image density to be appeared was conducted in the same manner as in Experiment 4.

Figure 10:
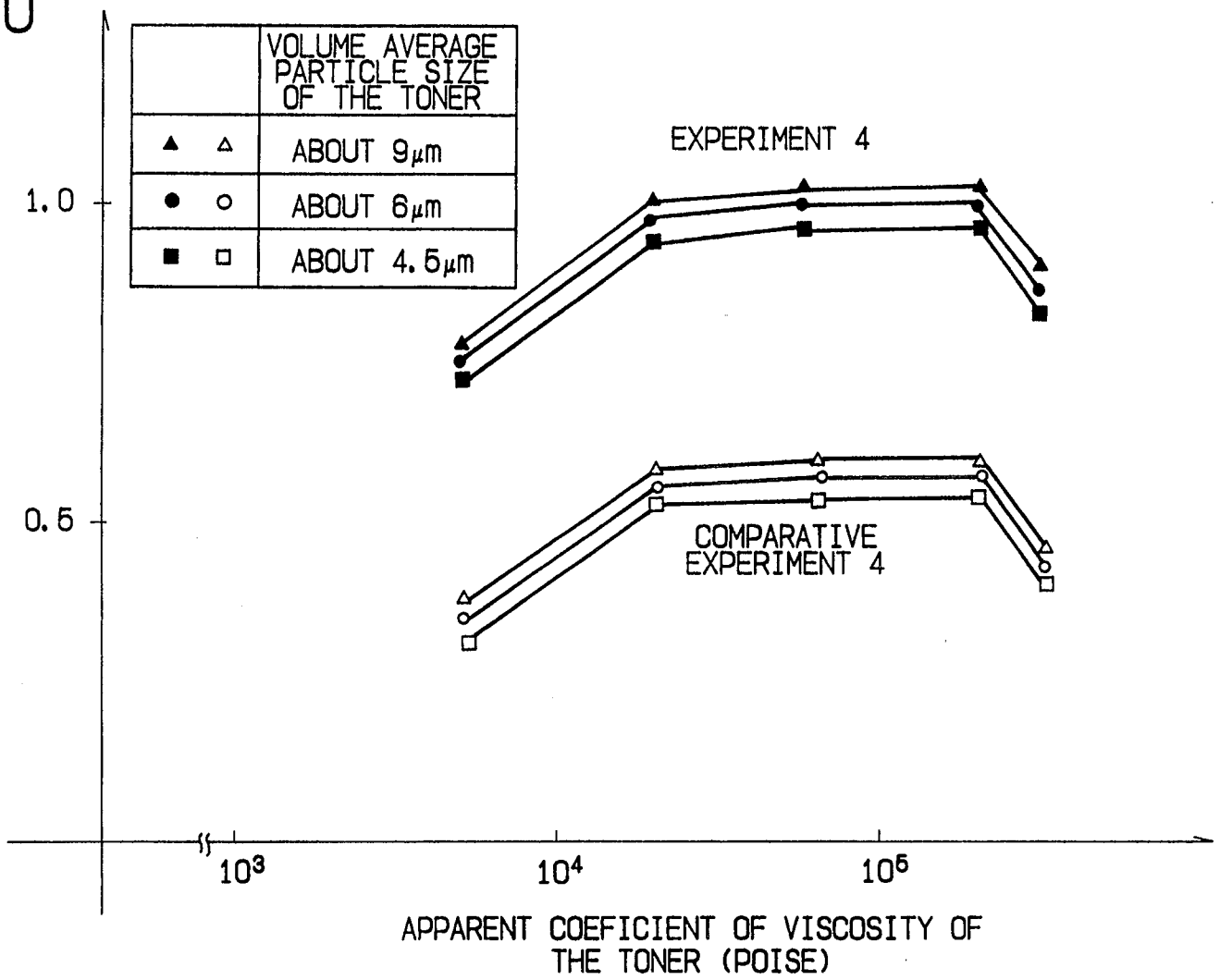
FIG. 10 shows graphs respectively illustrating the interrelations between the apparent viscosities of toner and the uneven image densities obtained in Example 4 and Comparative Example 4.

The evaluated results obtained in Experiment 4 and Comparative Experiment 4 were collectively shown in FIG. 10 in the same manner as in the case of FIG. 7, wherein the values plotted are relative values obtained when the value obtained in the case where the fine particle color toner having an apparent viscosity at 100° C. of about $6\times10^4$ posise was used was made to be the control (1).

Observations

From the results obtained in Experiment 2 and Comparative Experiment 2, it has been found that when the specific amorphous silicon light receiving member according to the present invention is used in combination with the specific fine particle color toner having a volume average particle size of 4.5 to 9 μm and an apparent viscosity at 100° C. of $1\times10^4$ to $2\times10^5$ high quality full collor pictorial images extremely excelling in both the tone reproduction and the resolution without accompaniment of any uneven image density are stably and repeatedly obtained even upon repeating the image-forming process for a long period of time.

Total Observation

Other than those observed in the foregoing experiments and comparative experiments, the followings have been also found.

That is, through Experiment 1 and Comparative Experiment 1, it has been found that the electrophotographic image-forming method using the foregoing specific amorphous silicon light receiving member and the foregoing specific fine particle toner in combination makes it possible to stably and repeatedly reproduce high quality images extremely excelling in both the tone reproduction and the resolution which are equivalent to the original, wherein a coulomb force effectively works between the latent image support layer of the light receiving member and the fine particle toner. Then, through Experiments 2–4 and Comparative Experiments 2–4, it has been found that the electrophotographic image-forming method using the foregoing specific amorphous silicon light receiving member and the foregoing specific fine particle toners [yellow toner (y), magenta toner (M), cyanic toner (C) and black toner (B)] makes it possible to stably and repeatedly reproduce high quality full color pictorial images extremely excelling in both the tone reproduction and the resolution which are equivalent to the original even upon repeating the image-forming process for along period of time without the corona wire stained with oil to be used for preventing the occurrence of offset but in the conventional image-forming method in the comparative examples, the corona wires are stained to cause uneven image density on the resultant images and the images reproduced are apparently inferior to any of the images obtained in the experiments.

DESCRIPTION OF THE PREFERRED EMBODIMENTS

The present invention will be described more specifically while referring to Examples, but the invention is not intended to limit the scope only to these examples.

EXAMPLE 1

The cylindrical light receiving member prepared Experiment 1 was set to a commercially available CANON Color Laser Copier PIXEL which has basically the same constitution as that shown in FIG. 2(*b*) wherein the four kinds of the fine particle insulating color toners obtained in Toner Production Example 2 were used. The electrophotographic image-forming method was carried out under normal environmental conditions (at 23° C., at a humidity of 60%) by using a CANON Test Sheet CA-4 for use in image evaluation in accordance with the foregoing image-forming procedures using the electrophotographic copying system of FIG. 2 (*b*), to thereby reproduce images of the original.

As a result of evaluating the resultant images, in has been found that they are excellent in both the resolution and the tone reproduction without accompaniment of any uneven image density and of any unfocused image and they are equivalent to the originals of the test sheet.

Then, the above electrophotographic image-forming process was continuously repeated to provide 500,000 copies. The images reproduced on the last copy were evaluated. As a result, it has been found that they are equivalent to those obtained at the initial stage and are still equivalent to the originals of the test sheet.

EXAMPLE 2

The cylindrical light receiving member prepared in Experiment 1 was set to a commercially available CANON Color Laser Copier PIXEL which has basically the same constitution as that shown in FIG. 2(*b*) wherein the four kinds of the charged with the fine particle insulating color toners obtained in Toner Production Example 3 were used. The electrophotographic image-forming method was carried out under high humid conditions (at 23° C., at a humidity of 85%) by using a CANON Test Sheet CA-4 for use in image evaluation in accordance with the foregoing image-forming procedures using the electrophotographic copying system of FIG. 2 (*b*), to thereby reproduce images of the original.

As a result of evaluating the resultant images, it has been found that they are excellent in both the resolution and the tone reproduction without accompaniment of any uneven image density and of any unfocused image and they are equivalent to the originals of the test sheet.

Then, the above electrophotographic image-forming process was continuously repeated to provide 500,000 copies. The images reproduced .on the last copy were evaluated. As a result, it has been found that they are equivalent to those obtained at the initial stage and are still equivalent to the originals of the test sheet.

TABLE 1

| toner | colorant used | parts by weight | changing state controlling agent | parts by weight |
|---|---|---|---|---|
| yellow (Y) | C. I. Pigment Yellow 17 | 3.5 | di-tertiary-buthyl-salicylic acid chromium complex | 4.0 |
| magenta (M) | C. I. Solvent Red 52 | 1.0 | di-tertiary-buthyl-salicylic acid chromium complex | 4.0 |
| | C. I. Solvent Red 49 | 0.9 | | |
| cyanoger (C) | phthalocyanine of the structural formula (II) (n = 2) | 5.0 | di-tertiary-buthyl-salicylic acid chromium complex | 4.4 |
| black (B) | C. I. Pigment Yellow 17 | 1.2 | di-tertiary-buthyl-salicylic acid chromium complex | 4.4 |
| | C. I. Pigment Red 5 | 2.8 | | |
| | C. I. Pigment Blue 15 | 1.5 | | |

TABLE 2

| constituent layer | gas used and its flow rate (sccm) | | discharging power (W) | inner pressure (Torr) | substrate temperature (°C.) |
|---|---|---|---|---|---|
| charge injection inhibition layer | $SiH_4$ | 100 | 150 | 0.5 | 250 |
| | $H_2$ | 500 | | | |
| | $PH_3/SiH_4$ | 500 ppm | | | |
| photoconductive layer | $SiH_4$ | 300 | 500 | 0.5 | 250 |
| | $H_2$ | 500 | | | |
| | $B_2H_6/SiH_4$ | 0.1 ppm | | | |
| latent image support layer | $SiH_4$ | 100 | 300 | 0.3 | 250 |
| | $CH_4$ | 100 | | | |
| | $B_2H_6/SiH_4$ | 500 ppm | | | |
| developed image support layer | $SiH_4$ | 100 | 100 | 0.5 | 250 |
| | $CH_4$ | 500 | | | |

TABLE 3

| constituent layer | gas used and its flow rate (sccm) | | discharging power (W) | inner pressure (Torr) | substrate temperature (°C.) |
|---|---|---|---|---|---|
| charge injection inhibition layer | $SiH_4$ | 100 | 150 | 0.5 | 250 |
| | $H_2$ | 500 | | | |
| | $PH_3/SiH_4$ | 500 ppm | | | |
| photoconductive layer | $SiH_4$ | 300 | 500 | 0.5 | 250 |
| | $H_2$ | 500 | | | |
| | $B_2H_6/SiH_4$ | 0.1 ppm | | | |
| surface protective layer | $SiH_4$ | 100 | 100 | 0.5 | 250 |
| | $CH_4$ | 500 | | | |
| | $B_2H_6/SiH_4$ | | | | |

What is claimed is:

1. An electrophotographic process comprising the steps of:

(a) charging a light receiving member for use in electrophotography comprising a substrate and a light receiving multilayer, said light receiving multilayer comprising (i) a charge injection inhibition layer comprising an amorphous material containing silicon atoms as a matrix; (ii) a photoconductive layer comprising an amorphous material containing silicon atoms as a matrix and at least one kind of atom selected from the group consisting of hydrogen atoms and halogen atoms; (iii) a latent image supporting layer comprising an amorphous material containing silicon atom as a matrix, carbon atoms, atoms of an element belonging to Group III of the Periodic Table and at least one kind of atom selected from the group consisting of hydrogen atoms and halogen atoms; and (iv) a developed image supporting layer comprising an amorphous material containing silicon atoms as a matrix, carbon atoms and at least one kind of atoms selected from the group consisting of hydrogen atoms and halogen atoms.

(b) exposing the light receiving member to form a latent image;

(c) developing said latent image employing a fine particle insulating toner comprising a fine particle insulating toner comprising a colorant and a binder, said toner having a volume average particle size from 4.5 to 9 microns and an apparent viscosity from $1\times10^4$ to $2\times10^5$ poise at 100° C. to thereby form a developed toner image on said light receiving member; and (d) transferring said developed toner image formed on said light receiving member to a transfer sheet.

2. The electrophotographic image-forming method according to claim 1, wherein said developed image-supporting layer has a thickness of 3000 to 10000 Å.

3. The electrophotographic image-forming method according to claim 1, wherein said developed-image supporting layer has a specific resistance of $10^{12}$ to $10^{16}$ Ω.cm.

4. The electrophotographic image-forming method according to claim 1, wherein said light receiving layer further comprises a charge injection inhibition layer disposed between said substrate and said photoconductive layer.

5. The electrophotographic image-forming method according to claim 1, wherein said light receiving layer further comprises a long wavelength absorptive layer between said substrate and said photoconductive layer.

6. The electrophotographic image-forming method according to claim 5, wherein a long wavelength absorptive layer is disposed between said substrate and said charge injection inhibition layer.

7. An electrophotographic process for forming full color pictorial copied images comprising the steps of:

(a) charging a light receiving member for use in electrophotography comprising a substrate and a light receiving multilayer, said light receiving multilayer comprising (i) a charge injection inhibition layer comprising an amorphous material containing silicon atoms as a matrix; (ii) a photoconductive layer comprising an amorphous material containing silicon atoms as a matrix and at least one kind of atom selected from the group consisting of hydrogen atoms and halogen atoms; (iii) a latent image supporting layer comprising an amorphous material containing silicon atom as a matrix, carbon atoms, atoms of an element belonging to Group III of the Periodic Table and at least one kind of atom selected from the group consisting of hydrogen atoms and halogen atoms; and (iv) a developed image supporting layer comprising an amorphous material containing silicon atoms as a matrix, carbon atoms and at least one kind of atoms selected from the group consisting of hydrogen atoms and halogen atoms.

(b) exposing the light receiving member to form a latent image;

(c) developing said latent image employing a plurality of fine particle insulating toners of different colors, each said toner comprising a fine particle insulating toner comprising a colorant and a binder, said toner having a volume average particle size from 4.5 to 9 microns and an apparent viscosity from $1\times10^4$ to $2\times10^5$ poise at 100° C. to thereby form a developed toner image on said light receiving member; and (d) transferring said developed toner image formed on said light receiving member to a transfer sheet.

8. The electrophotographic image-forming method according to claim 7 wherein said developed image supporting layer has a thickness of 3000 to 10000 Å.

9. The electrophotographic image-forming method according to claim 7, wherein said developed image supporting layer has a specific resistance of $10^{12}$ to $10^{16}$ Ω.cm.

10. The electrophotographic image-forming method according to claim 7, wherein said light receiving layer further comprises a charge injection inhibition layer disposed between said substrate and said photoconductive layer.

11. The electrophotographic image-forming method according to claim 7, wherein said light receiving layer further comprises a long wavelength absorptive layer between said substrate and said photoconductive layer.

12. The electrophotographic image-forming method according to claim 11, wherein a long wavelength absorptive layer is disposed between said substrate and said charge injection inhibition layer.

* * * * *

UNITED STATES PATENT AND TRADEMARK OFFICE

CERTIFICATE OF CORRECTION

PATENT NO. : 5,358,811

DATED : October 25, 1994

INVENTOR(S) : KOJI YAMAZAKI, ET AL.

It is certified that error appears in the above-identified patent and that said Letters Patent is hereby corrected as shown below:

ON TITLE PAGE

In [54] Title: "MICRON" should read --MICRONS--.

IN THE DRAWINGS

Sheet 8 of 12, "RESOLUSION" should read --RESOLUTION--.
Sheet 10 of 12, "COEFICIENT" (both occurrences) should read --COEFFICIENT--.
Sheet 11 of 12, "COEFICIENT" (both occurrences) should read --COEFFICIENT--.
Sheet 12 of 12, "COEFICIENT" (both occurrences) should read --COEFFICIENT--.

COLUMN 1

Line 8, "MICRON" should read --MICRONS--.

COLUMN 2

Line 65, "size" should read --size by--.

COLUMN 3

Line 16, "using" should read --used--.

COLUMN 4

Line 16, "east" should read --least--.

COLUMN 6

Line 4, "substrate 1010" should read --substrate 101,--.
Line 10, "Group" should read --Group III--.

UNITED STATES PATENT AND TRADEMARK OFFICE

CERTIFICATE OF CORRECTION

PATENT NO. : 5,358,811

DATED : October 25, 1994

INVENTOR(S) : KOJI YAMAZAKI, ET AL.

It is certified that error appears in the above-identified patent and that said Letters Patent is hereby corrected as shown below:

COLUMN 6

Line 54, "a-aSi(H,X)" should read --of a-Si(H,X)--.

COLUMN 7

Line 29, "a-SiC(IT,X)" should read --a-SiC(H,X)--.

COLUMN 9

Line 9, "reservoir 571." should read --reservoir 571,--.
Line 10, "reservoir 572" should read --reservoir 572,-- and "reservoir 573" should read --reservoir 573,--.

COLUMN 10

Line 29, "ms" should read --is--.
Line 39, "upon" should be deleted.

COLUMN 11

Line 49, "a" should read --an--.
Line 50, "more" should read --more of--.

COLUMN 12

Line 43, "viocosity" should read --viscosity--.

COLUMN 13

Line 32, "method," should read --methods,--.

UNITED STATES PATENT AND TRADEMARK OFFICE

CERTIFICATE OF CORRECTION

PATENT NO. : 5,358,811

DATED : October 25, 1994

INVENTOR(S) : KOJI YAMAZAKI, ET AL.

It is certified that error appears in the above-identified patent and that said Letters Patent is hereby corrected as shown below:

COLUMN 14

Line 16, "hisphenol" should read --bisphenol--.
Line 54, "in" should read --in an---.

COLUMN 16

Line 26, "ms" should read --is--.
Line 49, "coated" should read --coated with--.

COLUMN 18

Line 5, "unforcused" should read --unfocused-- and "the" should read --of the--.
Line 36, "none" should read --tone--.

COLUMN 19

Line 39, "about:" should read --about--.

COLUMN 20

Line 1, "$2\times10^5$" should read --$2\times10^5$,--.
Line 38, "Experiment 2" should read --Experiment 3--.

COLUMN 21

Line 55, "posise" should read --poise--.
Line 65, "$2\times10^5$" should read --$2\times10^5$,--.
Line 66, "collor" should read --color--.

UNITED STATES PATENT AND TRADEMARK OFFICE

CERTIFICATE OF CORRECTION

PATENT NO. : 5,358,811

DATED : October 25, 1994

INVENTOR(S) : KOJI YAMAZAKI, ET AL.

It is certified that error appears in the above-identified patent and that said Letters Patent is hereby corrected as shown below:

COLUMN 22

Line 6, "followings" should read --following--.
Line 24, "(y)," should read --(Y),--.
Line 29, "along" should read --a long--.
Line 30, "wire" should read --wire being--.

COLUMN 23

Line 50, ".on" should read --on--.

COLUMN 24

TABLE 3, "protective layer $CH_4$ 500
$B_2H_6/SiH_4$"
should read
--protective layer $CH_4$ 500
$B_2H_6/SiH_4$ 500 ppm--.
Line 40, "An electrophotographic process" should read --An electrophotographic method--.
Line 53, "atom" should read --atoms--.
Line 62, "atoms." should read --atoms;--.
Line 66, "comprising a fine particle" should be deleted.

COLUMN 25

Line 27, "An electrophotographic process" should read --An electrophotographic method-- and "full" should read --full- --.
Line 40, "atom" should read --atoms--.

UNITED STATES PATENT AND TRADEMARK OFFICE

CERTIFICATE OF CORRECTION

PATENT NO. : 5,358,811

DATED : October 25, 1994

INVENTOR(S) : KOJI YAMAZAKI, ET AL.

It is certified that error appears in the above-identified patent and that said Letters Patent is hereby corrected as shown below:

COLUMN 26

Line 7, "atoms." should read --atoms;--.
Line 22, "claim 7" should read --claim 7,--.

Signed and Sealed this

Fourth Day of April, 1995

Bruce Lehman

*Attest:*

BRUCE LEHMAN

*Attesting Officer*

*Commissioner of Patents and Trademarks*